US009598222B2

(12) United States Patent
Kim

(10) Patent No.: US 9,598,222 B2
(45) Date of Patent: Mar. 21, 2017

(54) MEDICINE DISPENSING DEVICE

(71) Applicant: JVM CO., LTD., Daegu (KR)

(72) Inventor: Jun Ho Kim, Daegu (KR)

(73) Assignee: JVM CO., LTD., Daegu (KR)

( * ) Notice: Subject to any disclaimer, the term of this patent is extended or adjusted under 35 U.S.C. 154(b) by 0 days.

(21) Appl. No.: 14/511,300

(22) Filed: Oct. 10, 2014

(65) Prior Publication Data

US 2015/0102052 A1 Apr. 16, 2015

(30) Foreign Application Priority Data

Oct. 11, 2013 (KR) ..... 10-2013-0120969
Sep. 23, 2014 (KR) ..... 10-2014-0126905

(51) Int. Cl.

| | |
|---|---|
| ***G07F 11/44*** | (2006.01) |
| ***B65D 83/00*** | (2006.01) |
| ***G07F 11/00*** | (2006.01) |
| ***G07F 11/42*** | (2006.01) |
| ***G07F 11/58*** | (2006.01) |
| ***G07F 17/00*** | (2006.01) |

(52) U.S. Cl.

CPC ..... *B65D 83/00* (2013.01); *G07F 11/005* (2013.01); *G07F 11/42* (2013.01); *G07F 11/44* (2013.01); *G07F 11/58* (2013.01); *G07F 17/0092* (2013.01)

(58) Field of Classification Search

CPC ..... B65B 3/003
See application file for complete search history.

(56) References Cited

U.S. PATENT DOCUMENTS

| | | | | |
|---|---|---|---|---|
| 4,460,106 | A * | 7/1984 | Moulding et al. | 221/1 |
| 5,337,919 | A * | 8/1994 | Spaulding et al. | 221/2 |
| 5,405,048 | A * | 4/1995 | Rogers et al. | 221/211 |
| 5,472,113 | A * | 12/1995 | Shaw | 221/7 |
| 5,571,258 | A * | 11/1996 | Pearson | 221/211 |

(Continued)

FOREIGN PATENT DOCUMENTS

| | | |
|---|---|---|
| EP | 0 414 010 A1 | 2/1991 |
| EP | 2 168 556 A1 | 3/2010 |

(Continued)

*Primary Examiner* — Gene Crawford
*Assistant Examiner* — Ayodeji Ojofeitimi
(74) *Attorney, Agent, or Firm* — Birch, Stewart, Kolasch & Birch, LLP

(57) ABSTRACT

Provided is a medicine dispensing device including: a medicine mounting portion that transports medicines mounted thereon; a dispensing portion that moves between a receiving position at which the medicines transported by the medicine mounting portion are received and a dispensing position at which the received medicines are dispensed; and a position movement preventing portion that prevents position movement of the medicines to be received later on when the medicines are received by the dispensing portion. The medicine dispensing device further includes a guide portion that guides the medicines mounted on the medicine mounting portion to a position corresponding to the receiving position, defines a space in which the medicines enter the dispensing portion at the receiving position, and causes a size of the entrance space to be adjusted based on sizes of the medicines.

15 Claims, 23 Drawing Sheets

(56) References Cited

U.S. PATENT DOCUMENTS

| | | | | |
|---|---|---|---|---|
| 5,860,563 | A * | 1/1999 | Guerra | B65G 47/24 221/172 |
| 6,202,827 | B1 | 3/2001 | Drewitz | |
| 6,427,865 | B1 * | 8/2002 | Stillwell et al. | 221/4 |
| 8,047,352 | B2 * | 11/2011 | Yuyama | B65B 3/003 198/413 |
| 2002/0125265 | A1 * | 9/2002 | Burggraf | 221/69 |
| 2003/0057230 | A1 * | 3/2003 | Stevens et al. | 221/200 |
| 2004/0034447 | A1 * | 2/2004 | Vollm | 700/235 |
| 2004/0188455 | A1 | 9/2004 | Shioya | |
| 2008/0264967 | A1 * | 10/2008 | Schifman et al. | 221/133 |
| 2009/0105876 | A1 * | 4/2009 | Simpson et al. | 700/242 |
| 2009/0254214 | A1 * | 10/2009 | Kudera | G07F 17/0092 700/231 |
| 2010/0030374 | A1 * | 2/2010 | Saltsov | 700/225 |
| 2011/0127288 | A1 | 6/2011 | Valota | |
| 2012/0004770 | A1 * | 1/2012 | Ooyen et al. | 700/235 |

FOREIGN PATENT DOCUMENTS

| | | | |
|---|---|---|---|
| WO | WO 2008/043631 | A1 | 4/2008 |
| WO | WO 2009/074851 | A1 | 6/2009 |
| WO | WO 2009/138865 | A1 | 11/2009 |
| WO | WO 2010/116245 | A1 | 10/2010 |

* cited by examiner (a)

(b)

(a)

(b)

MEDICINE DISPENSING DEVICE

CROSS-REFERENCE TO RELATED APPLICATION

This application claims priority to and the benefit of Korean Patent Application Nos. 10-2013-0120969 and 10-2014-0126905, filed on Oct. 11, 2013 and Sep. 23, 2014, the disclosure of which is incorporated herein by reference in its entirety.

BACKGROUND

1. Field of the Invention

The present invention relates to a medicine dispensing device, and more particularly, to a medicine dispensing device that is capable of accurately dispensing medicines based on a medicine dispensing request (for example, a prescription for a patient).

2. Discussion of Related Art

In general, medicines having various types and shapes may be included among medicines for a one-time dosage based on a prescription for a patient, and the medicines for a one-time dosage are put in a basket and transferred to the patient.

Various medicines to be put in one basket are collected from boxes storing the respective medicines into one basket according to types and the number of medicines indicated in a patient's prescription. The basket in which the medicines are collected is transferred to the patient, and the patient takes the medicines collected in the basket.

According to the related art, when various medicines are collected in one basket, a medicine specialist, such as a pharmacist, needs to manually take the medicines out of each vial storing the medicines, and put the medicines into the basket based on a patient's prescription. Thus, an identification task of reverifying collected medicines is necessary.

This also entails a certain risk of medicine-related emergencies due to the difficulty of guaranteeing accurate administration of medicines. On top of this risk, it also takes a long time to collect medicines based on a patient's prescription due to the complexity of the medicine collecting procedure, which results in low work efficiency.

For these reasons, research on automatically collecting various medicines from boxes storing the medicines is constantly being performed. However, there have been difficulties so far in providing accuracy and efficiency in medicine collecting, and thus convenience has not been able to be provided to users such as pharmacists.

SUMMARY OF THE INVENTION

The present invention is directed to providing a medicine dispensing device that accurately dispenses medicines based on a medicine dispensing request (for example, a prescription for a patient) and simultaneously improves dispensing efficiency.

One aspect of the present invention provides a medicine dispensing device including: a medicine mounting portion that transports medicines mounted thereon; a dispensing portion that moves between a receiving position at which the medicines transported by the medicine mounting portion are received and a dispensing position at which the received medicines are dispensed; and a position movement preventing portion that prevents position movement of the medicines to be received later on when the medicines are received by the dispensing portion.

The dispensing portion may receive the medicines that enter an entrance space in an upright state at the receiving position, and then may dispense the medicines in a different direction from a direction in which the medicines are received when the dispensing portion reaches the dispensing position, or before.

The dispensing portion may receive the medicines that enter the entrance space in the upright state at the receiving position and then may be moved to the dispensing position by rotation and then dispense the medicines in the upright state to be in a laid state.

The medicine dispensing device may further include a guide portion that guides the medicines mounted on the medicine mounting portion to a position corresponding to the receiving position, defines a space in which the medicines enter the dispensing portion at the receiving position, and causes a size of the entrance space to be adjusted based on sizes of the medicines.

The guide portion may include: a reference guide portion fixed to a predetermined position; a varying guide portion mounted on the reference guide portion so as to be transported; and a contact rotation portion that rotates on an endless belt so as to guide the medicines mounted on the medicine mounting portion to the position corresponding to the receiving position.

The reference guide portion and the varying guide portion may include a reference axis and a varying axis for rotation of the contact rotation portion, respectively.

The size of the entrance space may be determined based on a region in which the reference guide portion and the varying guide portion overlap.

One of the reference guide portion and the varying guide portion may include an accommodation portion that is depressed, and the other one of the reference guide portion and the varying guide portion may include an insertion portion that is inserted into the accommodation portion and causes a position of the varying guide portion to be fixed to the reference guide portion.

A plurality of accommodation portions may be spaced apart from each other, and a unit for adjusting the size of the entrance space may be determined based on a separation distance.

The contact rotation portion may include a movement portion and a plurality of pressurization portions that are spaced apart from the movement portion and protrude from the contact rotation portion so as to pressurize the medicines that come in contact with the movement portion toward the entrance space.

The contact rotation portion may be linked to the medicine mounting portion and may rotate on the endless belt.

The medicine mounting portion may cause the medicines that enter the entrance space to be received by the dispensing portion at the receiving position.

When the medicines mounted on the medicine mounting portion pass through the entrance space, the position movement preventing portion may be transported and may prevent communication between the entrance space and the dispensing portion, and when the medicines that pass through the entrance space are dispensed by movement of the dispensing portion, the position movement preventing portion may be returned to its original position and may allow communication between the entrance space and the dispensing portion.

The medicine dispensing device may further include a discharge adjusting portion that adjusts whether the medicines dispensed by the dispensing portion are discharged to an outside, wherein the discharge adjusting portion may be linked to the dispensing portion.

The medicine dispensing device may further include an alignment portion that defines the number of medicines mounted on the medicine mounting portion and is transported in the same direction in which the medicines mounted on the medicine mounting portion are transported, so that the medicines mounted on the medicine mounting portion can be maintained in the upright state when the medicines mounted on the medicine mounting portion are transported.

In a medicine dispensing device according to the present invention, necessary medicines can be accurately and rapidly dispensed based on a medicine dispensing request (for example, a prescription for a patient).

In addition, damage to the medicines can be prevented when the medicines are dispensed.

In addition, the number of medicines that can be kept in a limited space is maximized so that a time at which a certain medicine is replaced can be postponed.

Furthermore, medicines having various sizes are dispensed so that dispensing efficiency can be maximized.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
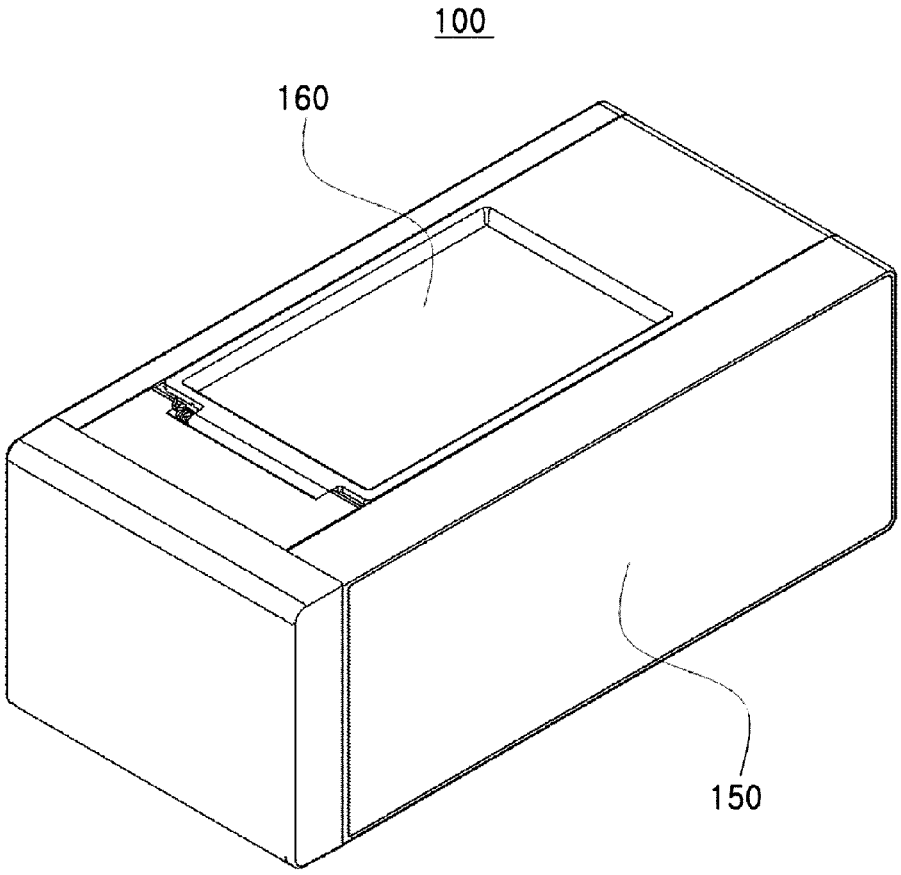
FIG. 1 is a schematic perspective view of a medicine dispensing device according to an embodiment of the present invention.

Hereinafter, exemplary embodiments of the present invention will be described with reference to the drawings in detail. However, the present invention is not limited to the exemplary embodiments disclosed below, but one of ordinary skill in the art that understands the present invention can easily suggest another retrogressive invention or other embodiments within the scope of the present invention by adding, modifying or deleting other elements within the scope of the same idea. It will be understood that this is also included in the scope of the present invention.

Also, like reference numerals are used for like elements having the same functions within the scope of the same idea shown in the drawings of each embodiment.

Figure 2:
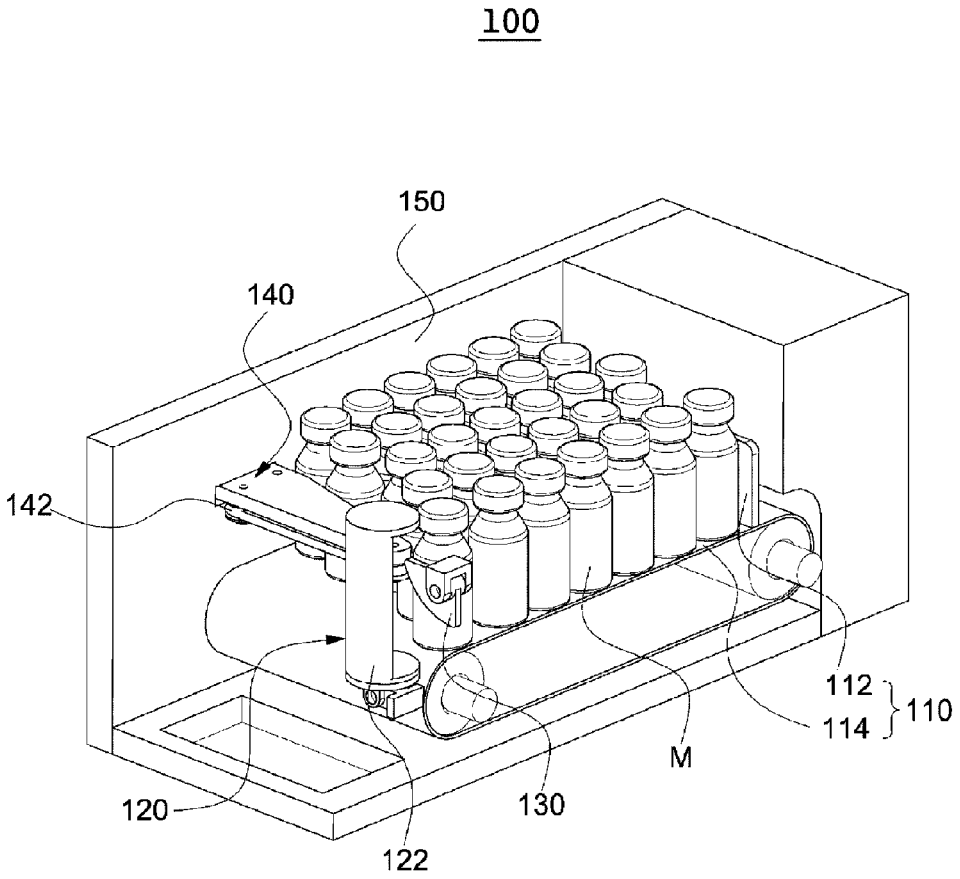
FIG. 2 is a view of an internal configuration of a medicine dispensing device according to an embodiment of the present invention.

FIG. 1 is a schematic perspective view of a medicine dispensing device according to an embodiment of the present invention, and FIG. 2 is a view of an internal configuration of a medicine dispensing device according to an embodiment of the present invention.

Referring to FIGS. 1 and 2, a medicine dispensing device 100 according to an embodiment of the present invention may include a medicine mounting portion 110 on which medicines M are mounted and which transports the mounted medicines M, a dispensing portion 120 that pivots between a receiving position at which the medicines M are received and a dispensing position at which the medicines M are dispensed, and a position movement preventing portion 130 that prevents the positions of the medicines M from moving.

Here, the medicines M may be in vials, as illustrated in FIG. 2. However, embodiments of the present invention are not limited thereto. The medicines M may include medicines having various sizes and shapes, such as ampoules, refined chemicals, powders or pouch type chemicals, or medical instruments such as syringes.

A plurality of medicine dispensing devices 100 according to an embodiment of the present invention may be mounted on a cartridge. As the cartridge is mounted in layers on which medicine dispensing equipment is mounted, the medicine dispensing device 100 may be mounted in a plurality of layers within the medicine dispensing equipment.

Thus, the medicine dispensing device 100 may store and dispense the medicines M based on a medicine dispensing request, i.e., a prescription for a patient, within the medicine dispensing equipment. The operation of keeping and dispensing the medicines M may be implemented by position movement of the medicine mounting portion 110, the dispensing portion 120, and the position movement preventing portion 130.

In detail, the medicine mounting portion 110 may be disposed in a body portion 150. The medicines M may be mounted upright on one surface of the medicine mounting portion 110, and when the medicines M are required to be dispensed, the medicine mounting portion 110 may move the medicines M forward through position movement.

Here, in terms of terminology regarding directions, forward may refer to a direction from the medicines M to the dispensing portion 120, and rearward may refer to the opposite direction.

The medicine mounting portion 110 may include a belt portion 114 on which the medicines M are mounted and transported along an endless belt, and an escape preventing portion 112 that is disposed on the belt portion 114 and prevents the medicines M from escaping from the belt portion 114.

The escape preventing portion 112 may be fastened to the belt portion 114 and may interlock therewith. However, the escape preventing portion 112 may simply be mounted on one surface of the belt portion 114.

The escape preventing portion 112 may prevent the medicines M from falling rearward due to inertia when the belt portion 114 moves and stops suddenly. Thus, the medicines M may be aligned to achieve accuracy in sequentially dispensing the medicines M.

The body portion 150 may include a cover portion 160 for externally exposing the medicine mounting portion 110 so that the medicines M can be replaced. The cover portion 160 may be mounted on a top surface of the body portion 150, as illustrated in FIG. 1.

However, the cover portion 160 may be mounted at various positions including a side of the body portion 150 according to an intention of one of ordinary skill in the art.

The dispensing portion 120 may pivot between the receiving position at which the medicines M transported by the medicine mounting portion 110 are received, and the dispensing position at which the received medicines M are dispensed.

Figure 5:
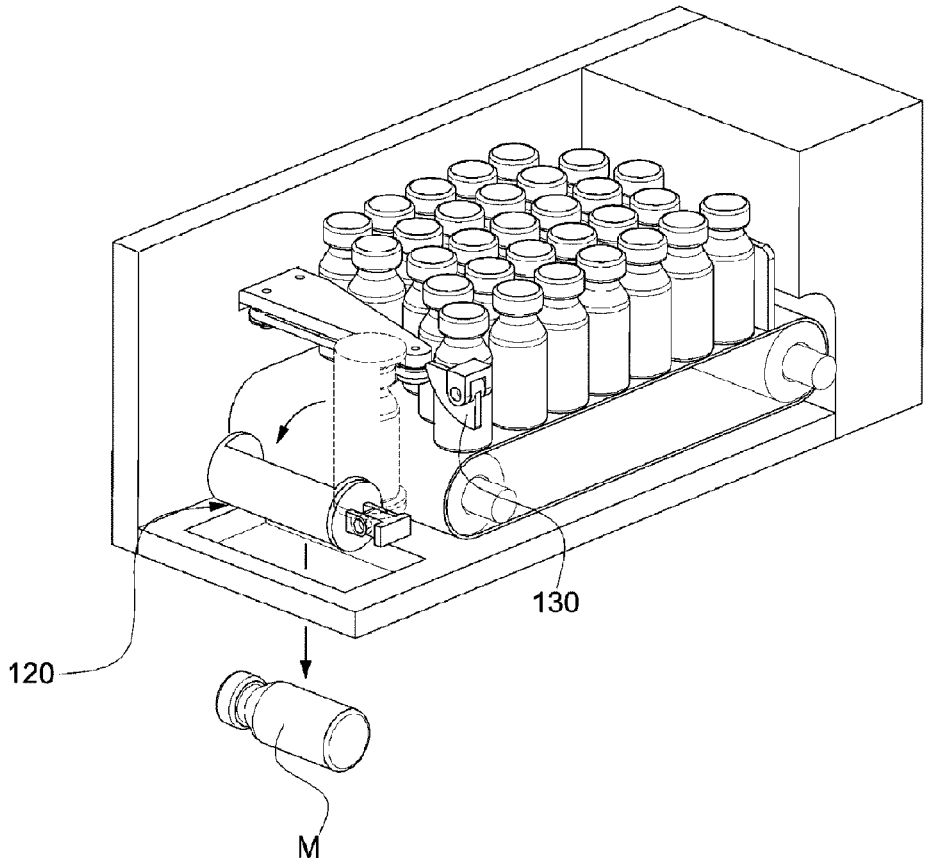
Figure 5:
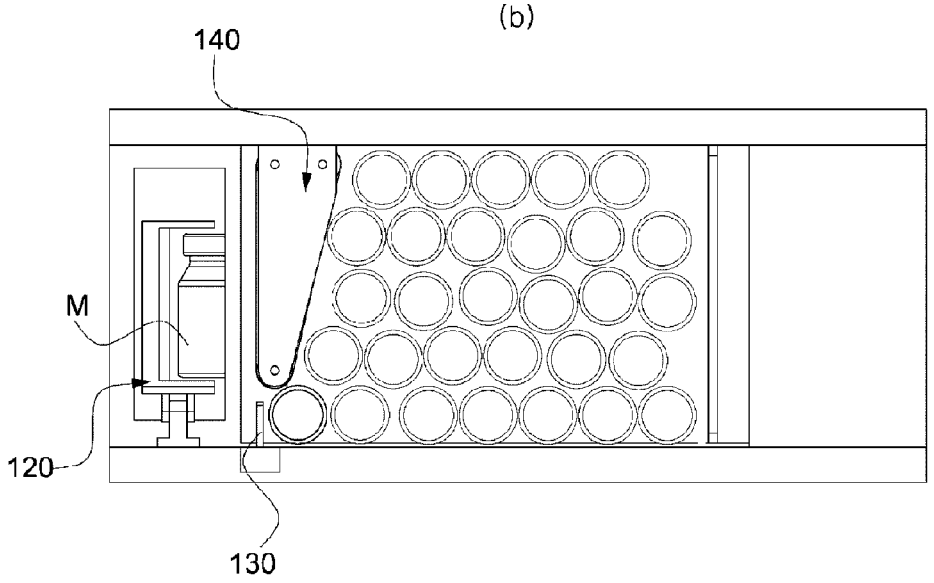

Here, the receiving position may refer to a position before the dispensing portion 120 is pivoted, i.e., a position of a state shown in FIG. 2, and the dispensing position may refer to a position in a state in which pivoting of the dispensing portion 120 is completed, as illustrated in FIG. 5.

The dispensing portion 120 receives the medicines M transported by the medicine mounting portion 110 at the receiving position and then is pivoted so that directions in which the medicines M are received and dispensed can be different from each other. In detail, the direction in which the medicines M are received may refer to a direction in which the medicines M are upright, and the direction in which the medicines M are dispensed may refer to a direction in which the medicines M are laid down.

In other words, the dispensing portion 120 may receive the medicines M mounted on the medicine mounting portion 110 at the receiving position while maintaining the same arrangement state. The dispensing portion 120 may include an inner surface that corresponds to at least a part of an outer surface of the medicines M, so as to receive one of the medicines M transported by the medicine mounting portion 110 at the receiving position.

The dispensing portion 120 may include a surrounding portion 122 that surrounds the part of the outer surface of the medicines M at the receiving position and exposes the other part thereof. The received medicines M may be dispensed as a portion exposed by the surrounding portion 122 due to pivoting of the dispensing portion 120.

In detail, the dispensing portion 120 may have a shape in which a part of a side is cut from a hollow cylinder, and the side that remains after being cut may be the surrounding portion 122.

The dispensing portion 120 may receive the medicines M transported by the medicine mounting portion 110 at the receiving position and then may be pivoted around a portion on which the received medicines M are mounted, so that the received medicines M can be automatically dispensed due to gravity.

In this case, a time at which the medicines M received by the dispensing portion 120 are dispensed may be a time at which the dispensing portion 120 reaches the dispensing position, or before. This may vary according to a contact relationship (frictional coefficient) between the dispensing portion 120 and the medicines M, pivoting speed of the dispensing portion 120 and the size of the surrounding portion 122.

The position movement preventing portion 130 may prevent position movement of the medicines M to be received later on when the medicines M are received by the dispensing portion 120. Thus, the position movement preventing portion 130 may cause the medicines M to be sequentially mounted on the dispensing portion 120 one at a time.

In detail, the position movement preventing portion 130 may control flow of the medicines M into the dispensing portion 120 according to whether the dispensing portion 120 is pivoted. The position movement preventing portion 130 may function as a kind of shutter.

That is, the position movement preventing portion 130 may control whether the medicines M pass through an outer side of the guide portion 140, which may be implemented according to whether the dispensing portion 120 is pivoted.

Here, the guide portion 140 is a kind of guide member that may move the medicines M mounted on the medicine mounting portion 110 to a position corresponding to the receiving position. The guide portion 140 may include a contact rotation portion 142 that is in contact with the medicines M mounted on the medicine mounting portion 110 and rotates on the endless belt so as to move the contacting medicines M to the outer side of the guide portion 140.

The contact rotation portion 142 may be a kind of rubber ring having elasticity. The medicines M mounted on the medicine mounting portion 110 may pass through the outer side of the guide portion 140 and thus may be received by the dispensing portion 120 placed at the receiving position.

As a result, a space through which only one of the medicines M may pass is formed between one side end of the guide portion 140 and the body portion 150. Opening and closing of the space may be controlled according to whether the position movement preventing portion 130 is pivoted.

A width that is viewed from an upper side of the guide portion 140 may narrow toward a position corresponding to the receiving position, which may be implemented when one surface on which the contact rotation portion 142 and the medicines M come in contact as a slanted surface.

However, a part of the guide portion 140 that formed as a slanted surface is not limited to the one surface on which the contact rotation portion 142 and the medicines M come in contact, but may also be formed on the opposite surface.

Also, in order for the width of the guide portion 140 to narrow toward the position corresponding to the receiving position, it is not necessary for at least surface to be slanted, and the surface may also be formed to be rounded.

The medicines M that come in contact with the contact rotation portion 142 may be moved forward toward the outer side of the guide portion 140. As a result, positions of the medicines M that come in contact with the contact rotation portion 142 may be different from each other.

Position movement of the medicine mounting portion 110, the position movement preventing portion 130 and the dispensing portion 120 and rotation of the contact rotation portion 142 may be implemented by a motor that may be disposed in the body portion 150. However, embodiments of the present invention are not limited thereto, and the position movement and the rotation may be implemented by an external force supplied from the outside.

Figure 3:
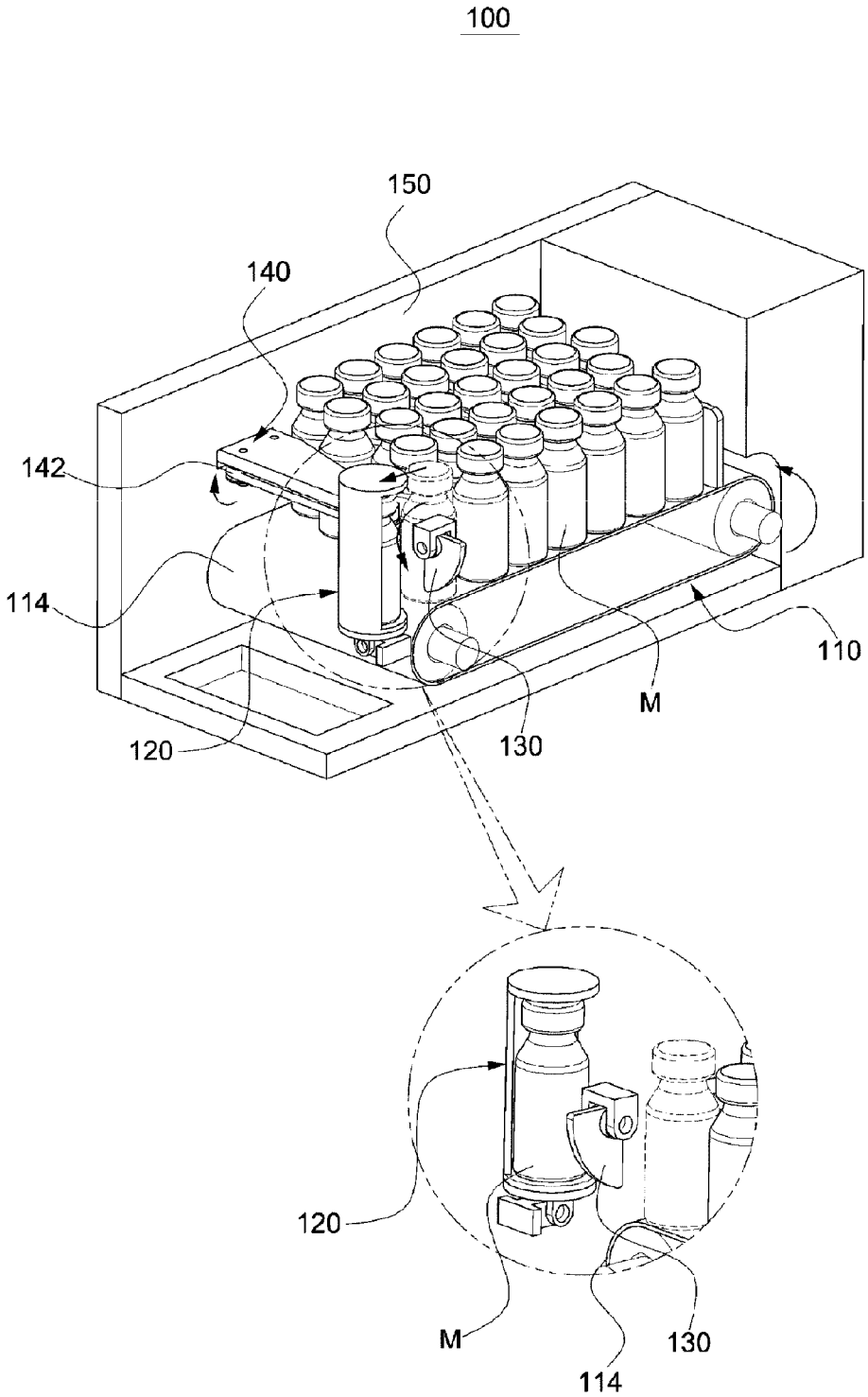
FIGS. 3 through 5 are views of an internal configuration for explaining an operating principle of a medicine dispensing device according to an embodiment of the present invention.
Figure 4:
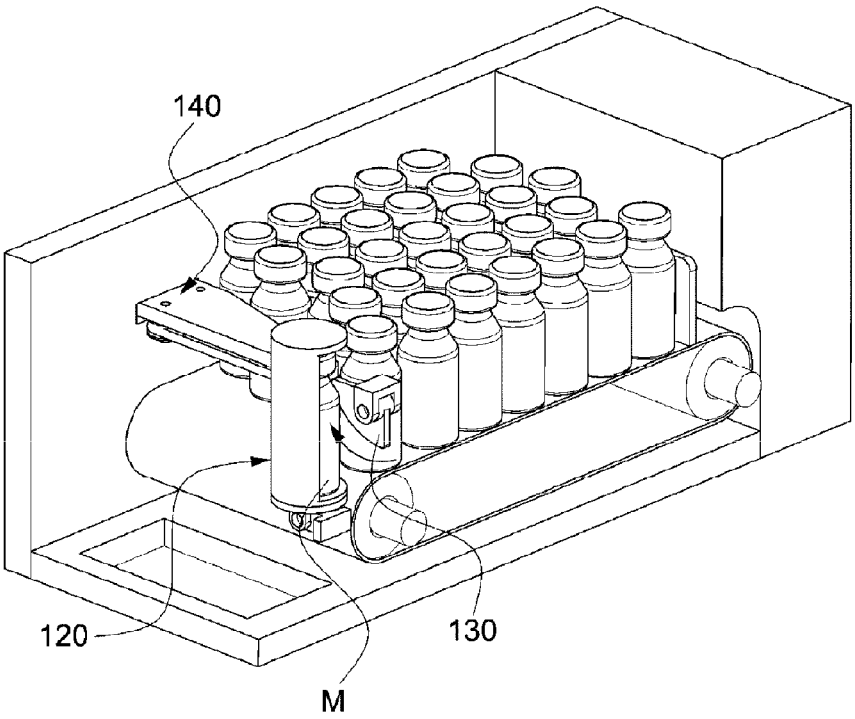
Figure 4:
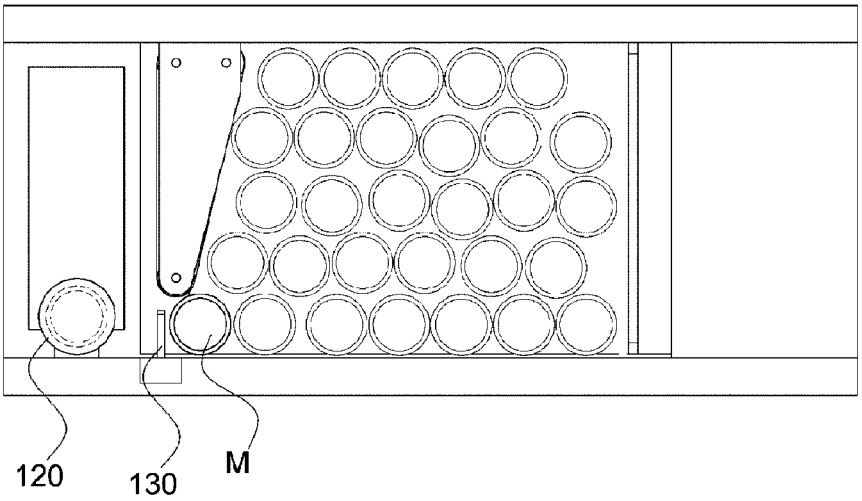

FIGS. 3 through 5 are views of an internal configuration for explaining an operating principle of a medicine dispensing device according to an embodiment of the present invention.

First, referring to FIG. 3, the belt portion 114 of the medicine mounting portion 110 is rotated so that the medicines M can be dispensed, and according to rotation of the contact rotation portion 142 of the guide portion 140, the medicines M mounted on the medicine mounting portion 110 flow into the outer side of the guide portion 140.

In this case, the position movement preventing portion 130 may be pivoted and may cause one of the medicines M to pass through the outer side of the guide portion 140. The medicine M that passes through the outer side of the guide portion 140 flows into the dispensing portion 120 placed at the receiving position.

As illustrated in FIG. 4, when the medicine M is received by the dispensing portion 120, the position movement preventing portion 130 may be returned to its original position and may prevent position movement of the medicines M to be received later on. Thus, the medicines M can be sequentially dispensed one at a time.

Referring to FIG. 5, the dispensing portion 120 that receives the medicines M may be pivoted from the receiving position to the dispensing position. In this procedure, the medicines M may automatically escape from the dispensing portion 120 and may be dispensed outward due to gravity.

If dispensing of the medicines M is completed, the dispensing portion 120 may be returned to the receiving position and may sequentially dispense the medicines M one at a time according to pivoting of the position movement preventing portion 130 and passing of the medicines M through the outer side of the guide portion 140.

Figure 6:
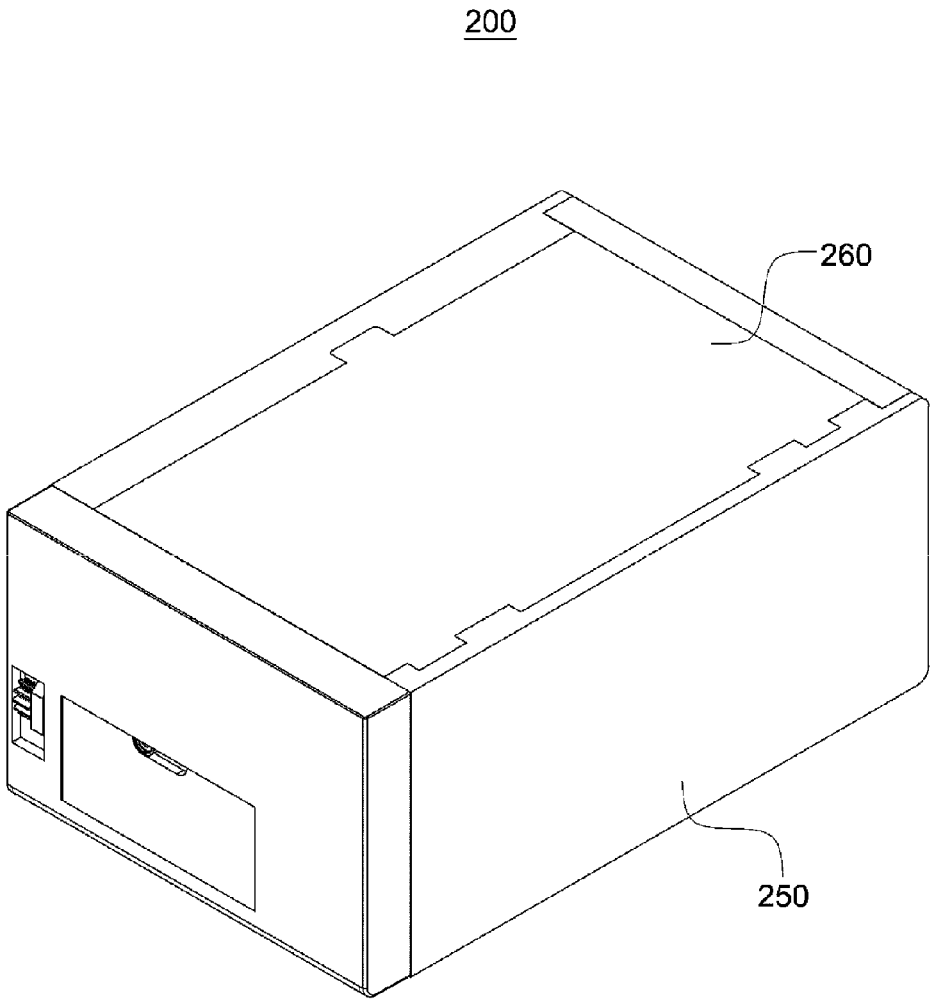
FIG. 6 is a schematic view of a medicine dispensing device according to another embodiment of the present invention.
Figure 7:
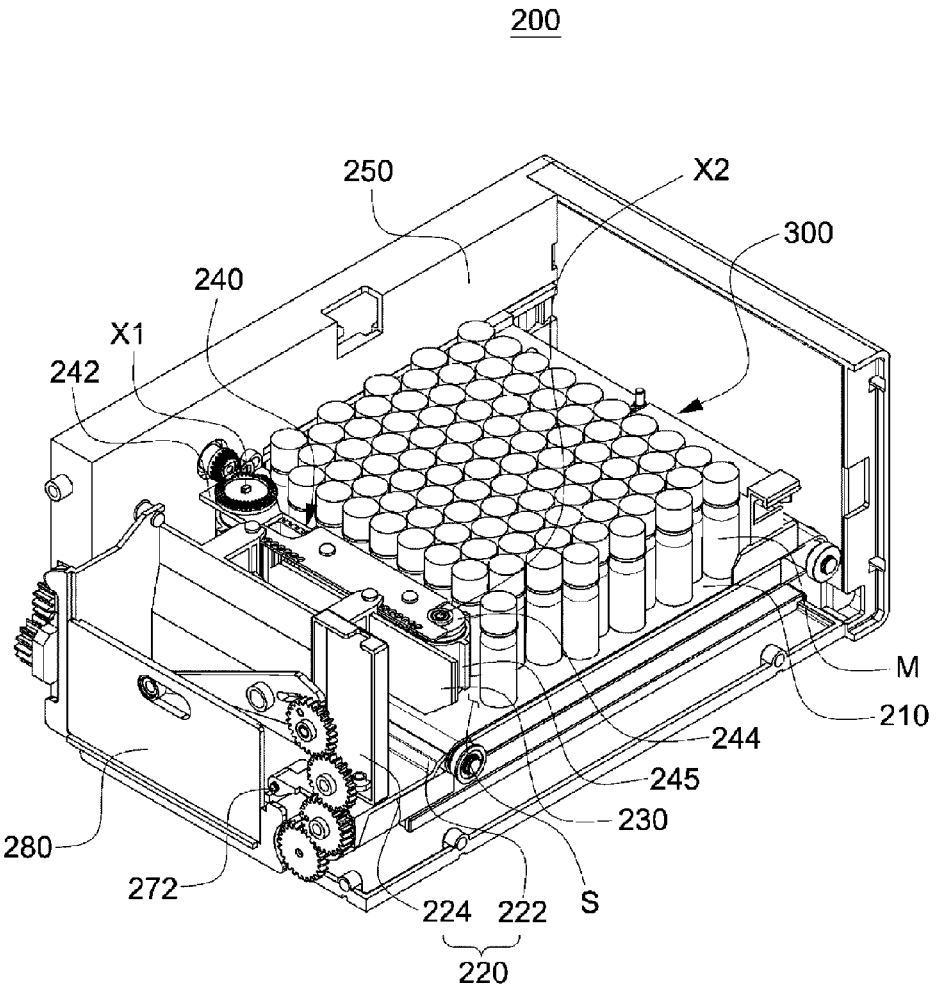
FIG. 7 is a view of an internal configuration of a medicine dispensing device according to another embodiment of the present invention.

FIG. 6 is a schematic view of a medicine dispensing device according to another embodiment of the present invention, and FIG. 7 is a view of an internal configuration of a medicine dispensing device according to another embodiment of the present invention.

Referring to FIGS. 6 and 7, a medicine dispensing device 200 according to another embodiment of the present invention may include a medicine mounting portion 210 that transports medicines M mounted in an upright state, a dispensing portion 220 that moves between a receiving position at which the medicines M are received and a dispensing position at which the medicines M are dispensed, a position movement preventing portion 230 that prevents position movement of the medicines M, and a guide portion 240 that defines an entrance space S in which the medicines M mounted on the medicine mounting portion 210 enter the dispensing portion 220 at the receiving position.

Here, the medicines M may be in vials, as illustrated in FIG. 7. However, embodiments of the present invention are not limited thereto. The medicines M may include medicines having various sizes and shapes, such as ampoules, refined chemicals, powders or pouch type chemicals, or medical instruments such as syringes.

A plurality of medicine dispensing devices 200 according to an embodiment of the present invention may be mounted on a cartridge. As the cartridge is mounted in layers on which medicine dispensing equipment is mounted, the medicine dispensing device 100 may be mounted in a plurality of layers within the medicine dispensing equipment.

Thus, the medicine dispensing device 200 may store and dispense the medicines M based on a medicine dispensing request, i.e., a prescription for a patient, within the medicine dispensing equipment. The operation of storing and dispensing the medicines M may be implemented by position movement of the medicine mounting portion 210, the dispensing portion 220, the position movement preventing portion 230, and the guide portion 240.

The medicine mounting portion 210 may be disposed in a body portion 250. The medicines M may be mounted upright on one surface of the medicine mounting portion 210, and when the medicines M are required to be dispensed, the medicine mounting portion 210 may be a kind of conveyor belt that may move the medicines M forward through position movement.

Here, in terms of terminology regarding directions, forward may refer to a direction from the medicines M to the dispensing portion 220, and rearward may refer to the opposite direction.

The body portion 250 may include a cover portion 260 that externally exposes the medicine mounting portion 210 so that the medicines M can be replaced. The cover portion 260 may be mounted on a top surface of the body portion 250, as illustrated in FIG. 6. However, the cover portion 260 may be mounted at various positions including a side of the body portion 250 according to an intention of one of ordinary skill in the art.

Figure 11:
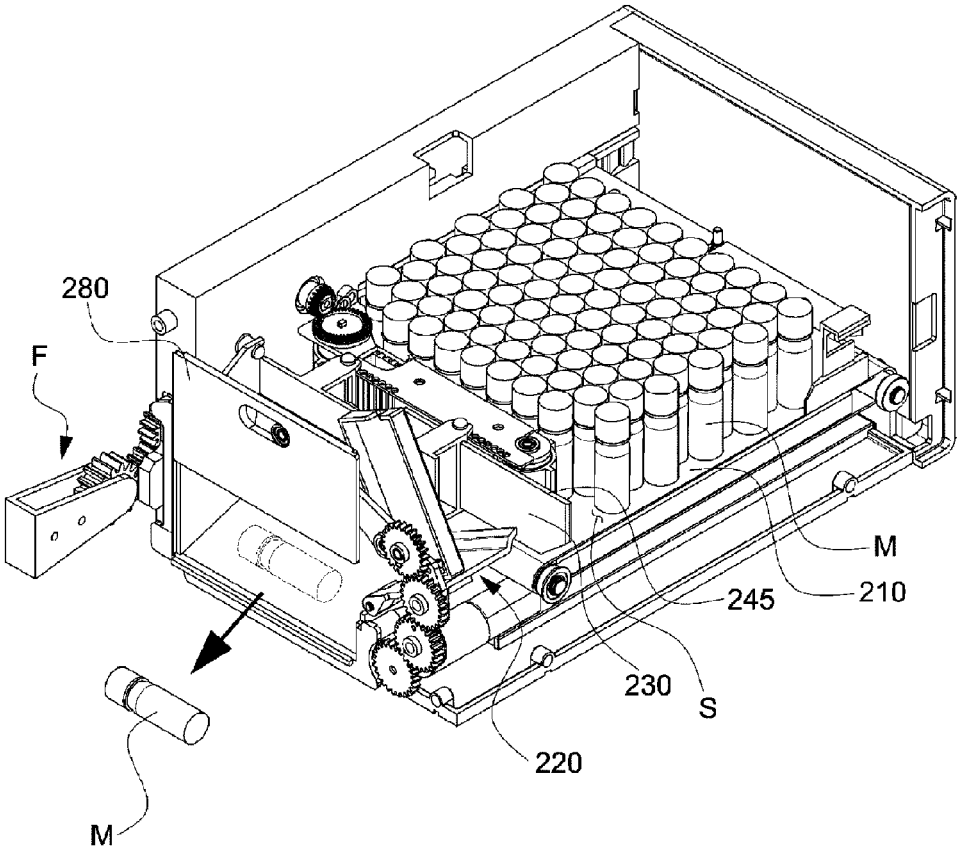

Here, the receiving position may refer to a position before the dispensing portion 220 is moved, i.e., a position shown in FIG. 7, and the dispensing position may refer to a position at which the medicines M are dispensed by the dispensing portion 220, as illustrated in FIG. 11.

However, the dispensing position may also refer to a position of the medicines M after being dispensed by the dispensing portion 220, undergoing further position movement, and finally completed position movement.

The dispensing portion 220 receives the medicines M transported by the medicine mounting portion 210 at the receiving position and then is transported, i.e., is rotated at a predetermined angle so that directions in which the medicines M are received and dispensed can be different from each other.

In detail, the dispensing portion 220 may receive the medicines M that enter the entrance space S defined by the guide portion 240 in the upright state at the receiving position and then may dispense the medicines M in a different direction from a direction in which the medicines M are received when the dispensing portion 220 reaches the dispensing position, or before.

In other words, the dispensing portion 220 may receive the medicines M in the upright state and then may be moved to the dispensing position by rotation and may dispense the medicines M in the upright state to be in a laid state.

The dispensing portion 220 may include a support portion 222 on which the medicines M moved from the medicine mounting portion 210 at the receiving position are mounted while being maintained in the upright state, and a preventing portion 224 that is connected to the support portion 222 so as to prevent escape of the medicines M mounted on the support portion 222. The dispensing portion 220 may cause the support portion 222 to be rotated around a rotation shaft 272 using a first driving portion (see 270 of FIGS. 13 through 15), and the medicines M mounted on the support portion 222 may be automatically dispensed due to gravity.

Position movement of the dispensing portion 220 will be described with reference to FIGS. 13 through 15 in detail.

The medicine dispensing device 200 according to an embodiment of the present invention may further include a discharge adjusting portion 280 that adjusts whether the medicines M dispensed by the dispensing portion 220 are discharged to the outside. The discharge adjusting portion 280 may be mounted on the body portion 250 so that the discharge adjusting portion 280 can be transported.

The discharge adjusting portion 280 may be linked to the dispensing portion 220. Thus, when the dispensing portion 220 is moved to the dispensing position, the dispensing portion 220 is moved to be in an open state so that the medicines M can be discharged to the outside.

When the medicines M are received by the dispensing portion 220 of the position movement preventing portion 230, the discharge adjusting portion 280 may be an element for preventing position movement of the medicines M to be received later on. Thus, the medicines M can be sequentially mounted on the dispensing portion 220 one at a time.

When the medicines M mounted on the medicine mounting portion 210 pass through the entrance space S, the position movement preventing portion 230 is transported by a driving force of a second driving portion (see 290 of FIGS. 16 and 17) so that communication between the entrance space S and the dispensing portion 220 can be prevented. Thus, the medicines M to be received later on can be prevented from being received by the dispensing portion 220 at the receiving position.

When the medicines M that pass through the entrance space S are dispensed by movement of the dispensing portion 220, the position movement preventing portion 230 may be returned to its original position so that communication between the entrance space S and the dispensing portion 220 can be allowed. Thus, the medicines M to be dispensed later on can be received by the dispensing portion 220 at the received position.

An operating principle of the position movement preventing portion 230 will be described with reference to FIGS. 16 and 17 in detail.

The guide portion 240 may be an element that guides the medicines M mounted on the medicine mounting portion 210 toward a position corresponding to the receiving position, defines the entrance space S in which the medicines M enter the dispensing portion 220 at the receiving position, and adjusts the size of the entrance space S based on the sizes of the medicines M.

In detail, the guide portion 240 may adjust the size of the entrance space S in which the medicines M enter the dispensing portion 220, to correspond to the sizes of the medicines M mounted on the medicine mounting portion 210. Thus, even when the sizes of the medicines M are changed, the guide portion 240 may adjust the size of the entrance space S to be suitable for the changed sizes of the medicines M.

The guide portion 240 may include a reference guide portion 242 that is fixed to a predetermined position of the body portion 250, a varying guide portion 244 mounted on the reference guide portion 242 so as to be transported, and a contact rotation portion 245 that rotates on the endless belt so as to guide the medicines M mounted on the medicine mounting portion 210 to correspond to the receiving position.

The size of the entrance space S may be changed according to a position at which the varying guide portion 244 is mounted on the reference guide portion 242. Here, the reference guide portion 242 and the varying guide portion 244 may include a reference axis X1 and a varying axis X2 for implementing rotation of the contact rotation portion 245.

Here, a distance between the reference axis X1 and the varying axis X2 is changed by the position at which the varying guide portion 244 is mounted on the reference guide portion 242. The distance may be in inverse proportion to the size of the entrance space S.

A detailed description thereof will be provided with reference to FIGS. 20 through 23.

The medicine dispensing device 200 according to an embodiment of the present invention may further include an alignment portion 300 that defines the number of medicines M mounted on the medicine mounting portion 210 and is transported in the same direction in which the medicines M mounted on the medicine mounting portion 210 are transported, so that the medicines M mounted on the medicine mounting portion 210 can be maintained in the upright state when the medicines M mounted on the medicine mounting portion 210 are transported.

The alignment portion 300 may be moved in a direction opposite to the direction in which the medicines M mounted on the medicine mounting portion 210 are transported only using external force. This will be described with reference to FIGS. 18 and 19 in detail.

FIGS. 8 through 11 are views for explaining an operating sequence of a medicine dispensing device according to another embodiment of the present invention.

Figure 8:
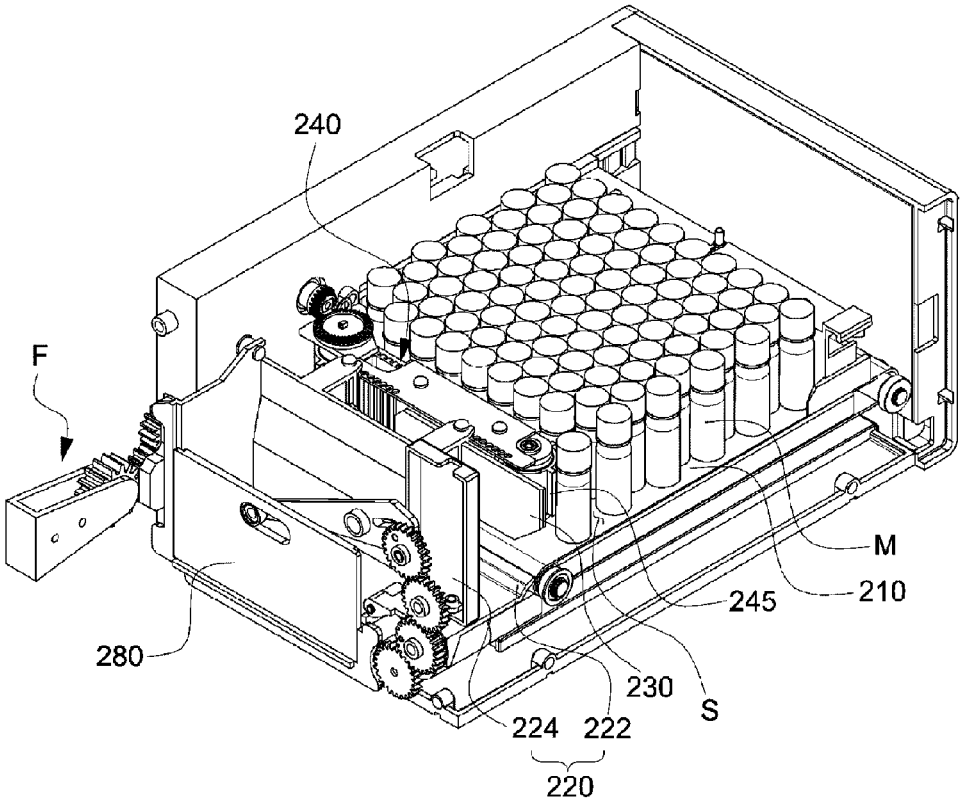
FIGS. 8 through 11 are views for explaining an operating sequence of a medicine dispensing device according to another embodiment of the present invention.

First, referring to FIG. 8, when a plurality of medicines M are mounted upright on the medicine mounting portion 210, due to a driving force applied by an external force applying portion F, the medicine mounting portion 210 and the guide portion 240 are linked to each other and transported.

In this case, the medicines M mounted on the medicine mounting portion 210 pass through the entrance space S provided between one side end of the guide portion 240 and the body portion 250 one at a time due to rotation of the medicine mounting portion 210 and the contact rotation portion 245 of the guide portion 240. The position movement preventing portion 230 allows communication between the entrance portion S and the dispensing portion 220.

Here, the entrance portion S may be provided by the guide portion 240 so as to correspond to the sizes of the medicines M. The medicine mounting portion 210 may cause the medicines M that enter the entrance space S to be received by the dispensing portion 220 at the receiving position.

Figure 9:
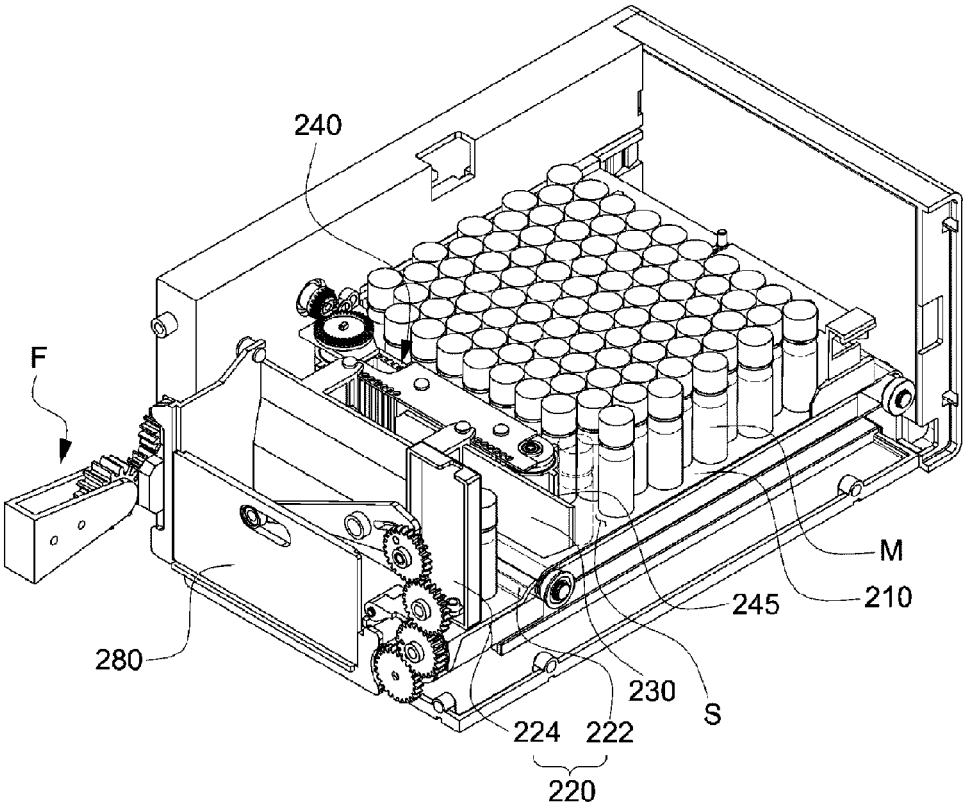

Referring to FIG. 9, when one medicine M passes through the entrance space S, the medicine M may be received by the dispensing portion 220 placed at the receiving position. The position movement preventing portion 230 may be transported so that the medicine M to be dispensed later on cannot pass through the entrance space S, and thus communication between the entrance space S and the dispensing portion 220 is prevented.

Figure 10:
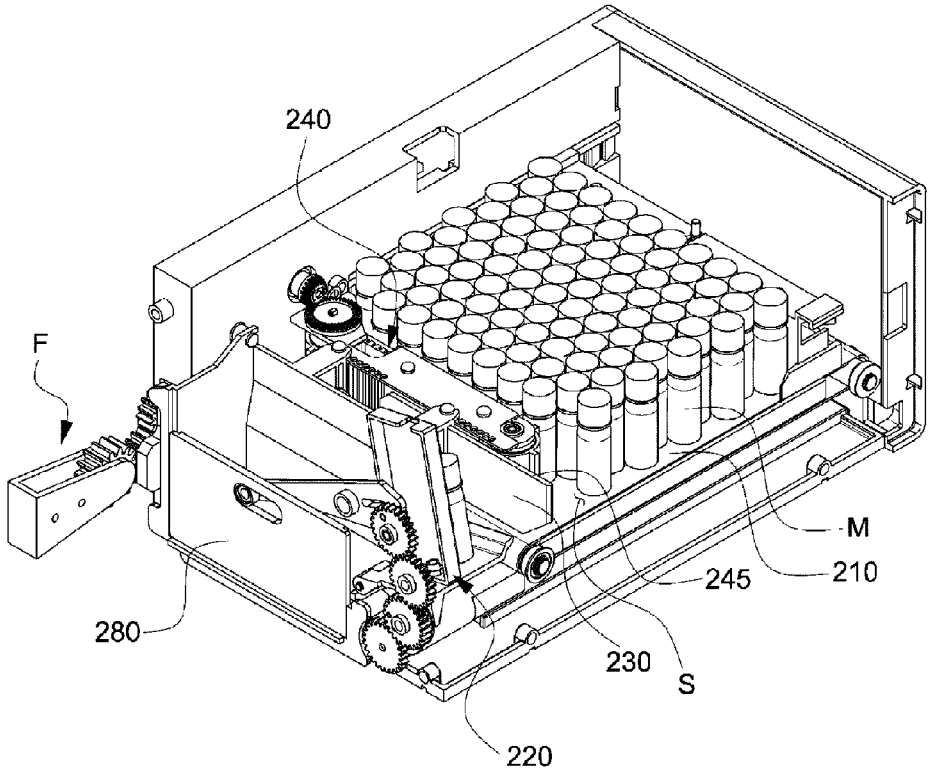

Referring to FIG. 10, when the medicines M moved from the medicine mounting portion 210 in the upright state are mounted on the support portion 222 of the dispensing portion 220 at the receiving position, the dispensing portion 220 is moved to the dispensing position by the driving force of the first driving portion 270.

In this case, the discharge adjusting portion 280 is linked to the dispensing portion 220 and is transported together with position movement of the dispensing portion 220.

Referring to FIG. 11, the dispensing portion 220 may receive the medicines M in the upright state at the receiving position and then may dispense the medicines M in a different direction from a direction in which the medicines M are received when the dispensing portion 220 reaches the dispensing position, or before.

As described above, when one medicine M is discharged to the outside, the procedure shown in FIGS. 8 through 11 may be repeated so that the medicines M can be sequentially discharged to the outside one at a time.

Figure 12:
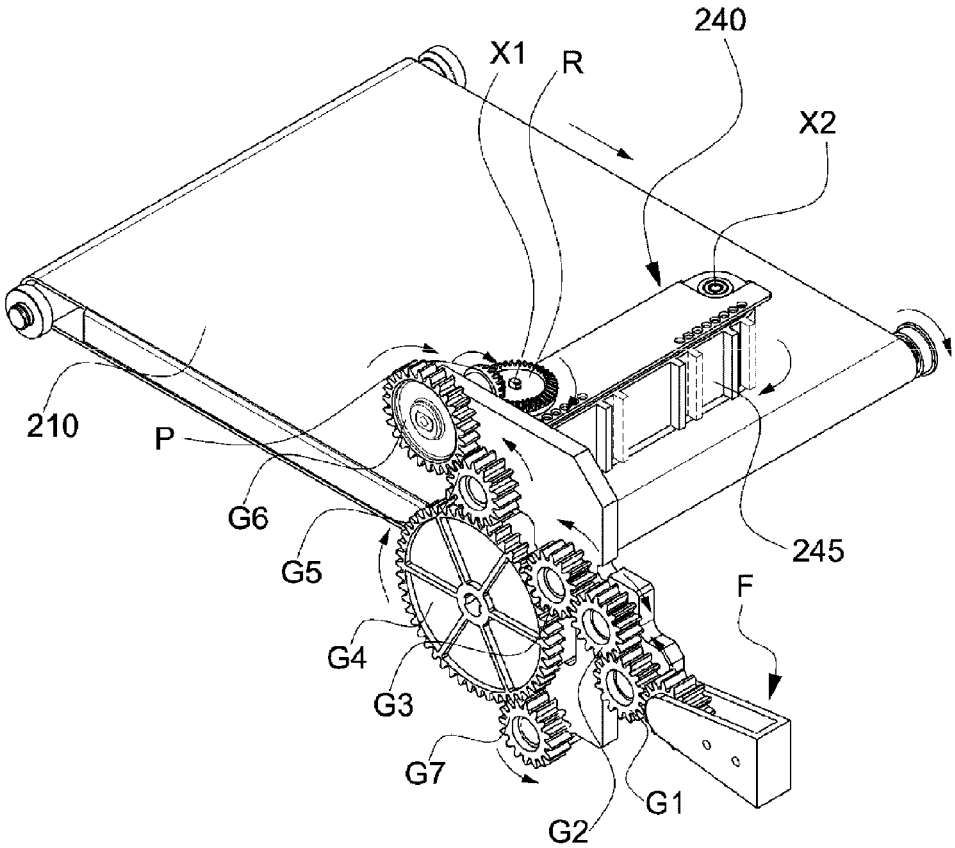
FIG. 12 is a view of an operating principle of a medicine mounting portion and a contact rotation portion of a medicine dispensing device according to another embodiment of the present invention.

FIG. 12 is a view of an operating principle of a medicine mounting portion and a contact rotation portion of a medicine dispensing device according to another embodiment of the present invention.

Referring to FIG. 12, the medicine mounting portion 210 and the contact rotation portion 245 of the guide portion 240 may be transported so that the medicines M mounted on the medicine mounting portion 210 can be received by the dispensing portion 220 at the receiving position.

Here, the driving force for position movement of the medicine mounting portion 210 and the contact rotation portion 245 may be provided by the external force applying portion F.

The external force applying portion F may include a gear that engages with a first spur gear G1. The gear may engage with the first spur gear G1 and then rotate so as to rotate the first spur gear G1.

When the first spur gear G1 is rotated, as illustrated in FIG. 7, a second spur gear G2, a third spur gear G3, a fourth spur gear G4, a fifth spur gear G5, a sixth spur gear G6, and a seventh spur gear G7 are rotated, and due to rotation of the fourth spur gear G4, the medicine mounting portion 210 may be rotated on the endless belt.

When the sixth spur gear G6 is rotated, a pinion gear P having the same rotation shaft is also rotated due to rotation of the sixth spur gear G6, and a ring gear R is rotated about the reference axis X1 due to rotation of the pinion gear P.

The pinion gear P and the ring gear R may be bevel gears, and the contact rotation portion 245 is rotated on the endless belt due to rotation of the ring gear R about the rotation shaft as the reference axis X1 and the varying axis X2.

Thus, position movement of the medicine mounting portion 210 and the contact rotation portion 245 may be implemented by the same driving force provided by the external force applying portion F. Due to the position movement, the medicines M pass through the entrance space S and are received by the dispensing portion 220 at the receiving position.

However, the position movement of the medicine mounting portion 210 and the contact rotation portion 245 is not necessarily implemented by the above-mentioned gears but may be implemented by different types of gears or a timing belt.

Figure 13:
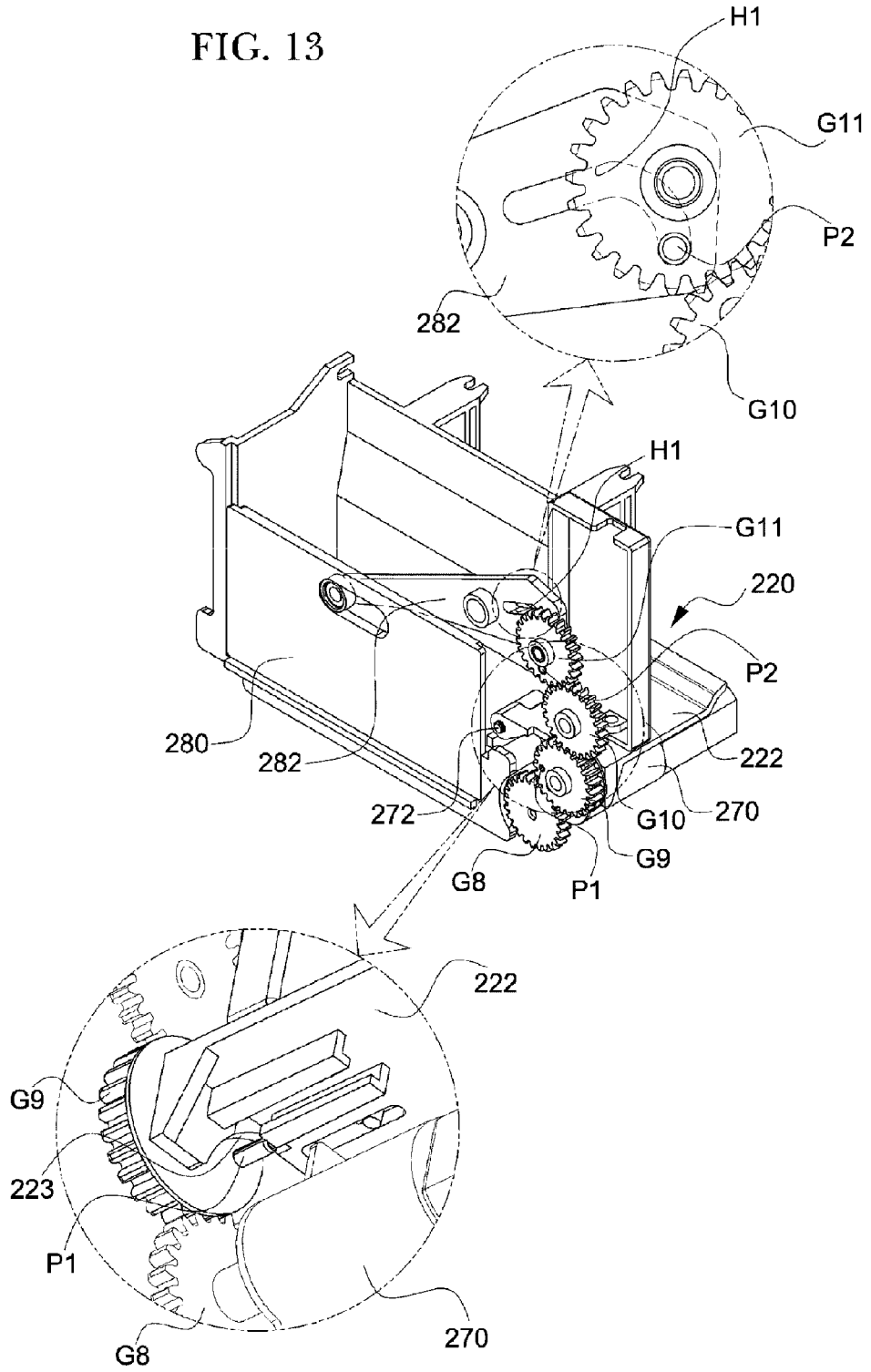
FIGS. 13 through 15 are views of an operating principle of a dispensing portion and a discharge adjusting portion of a medicine dispensing device according to another embodiment of the present invention.
Figure 14:
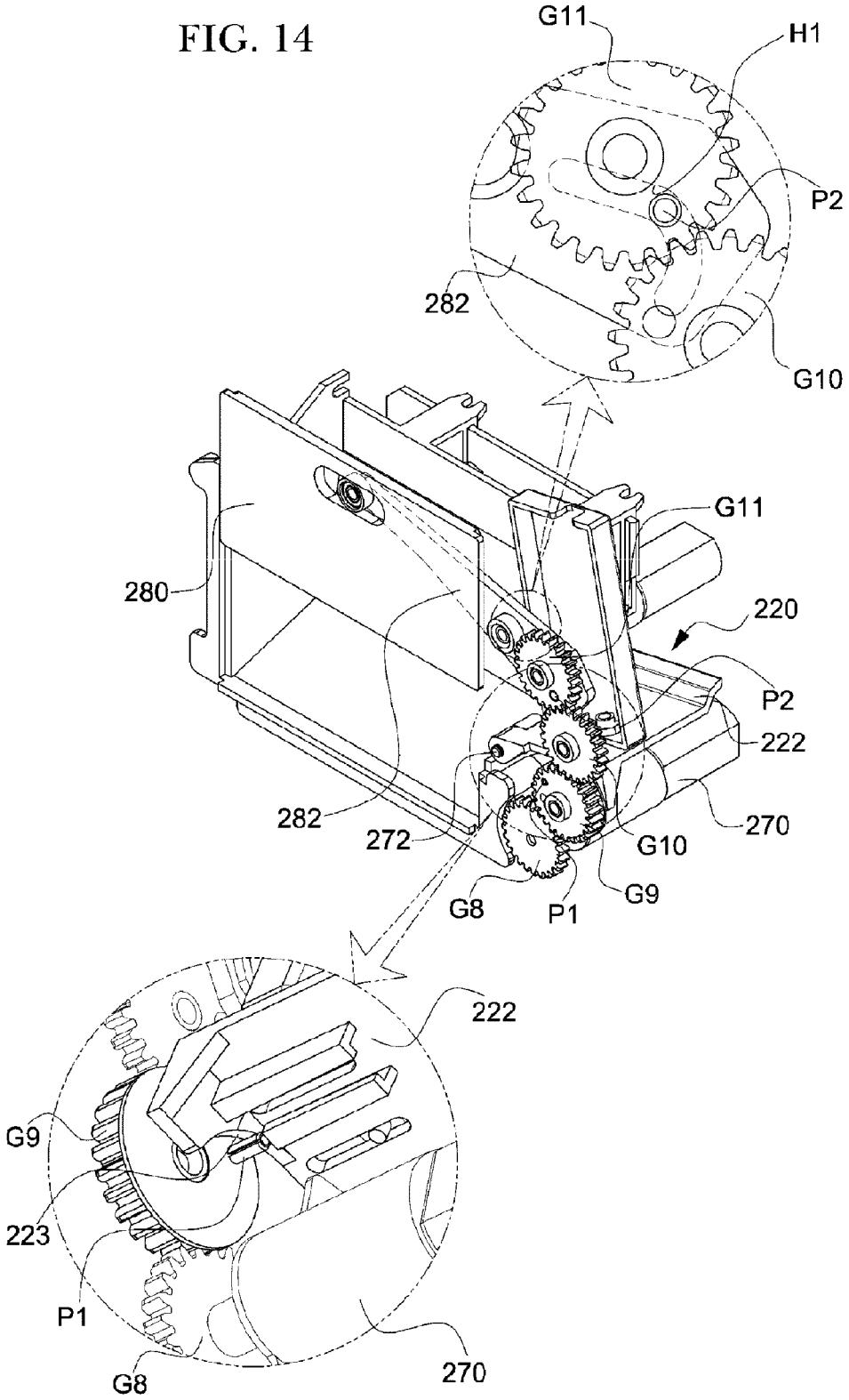
Figure 15:
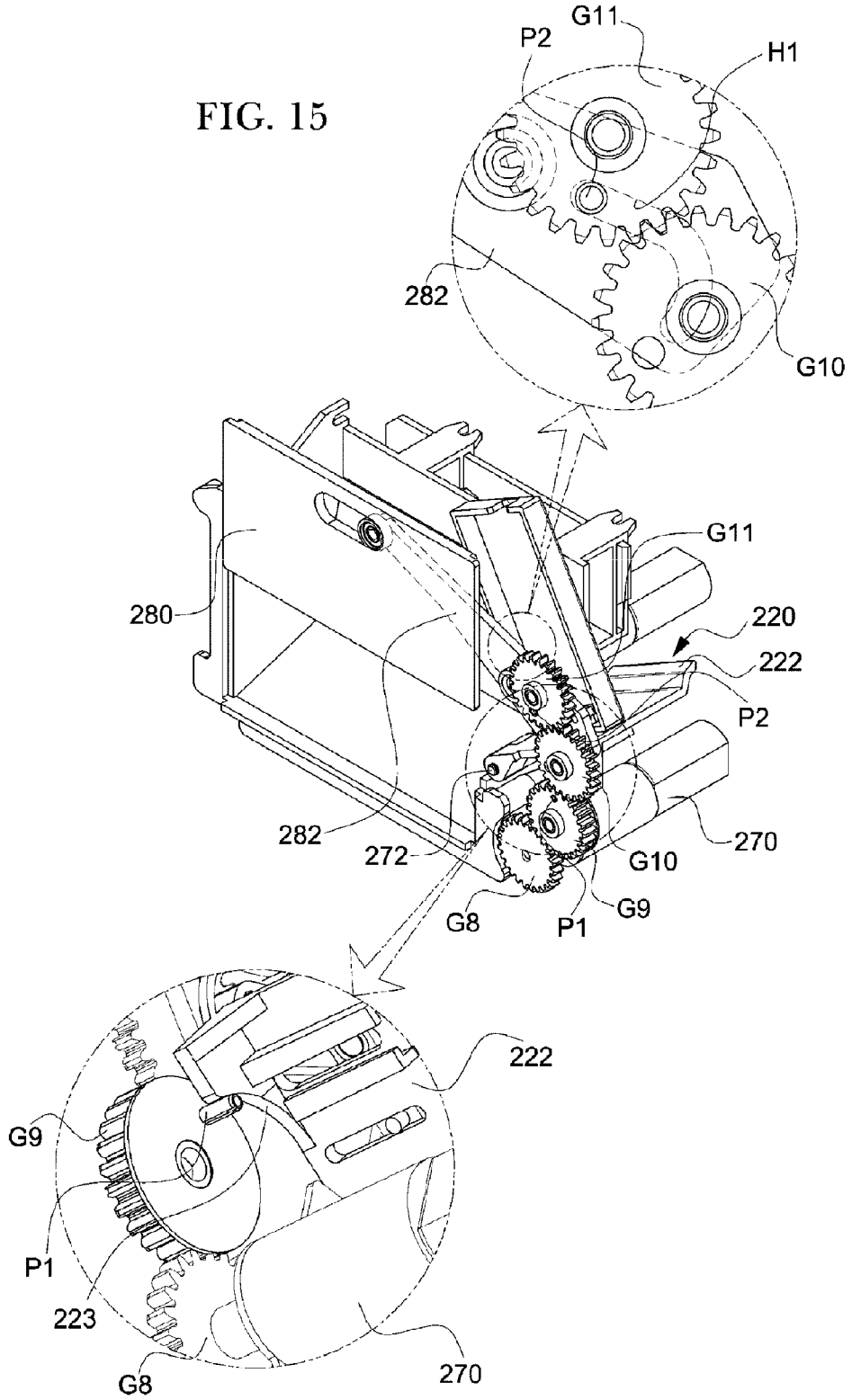

FIGS. 13 through 15 are views of an operating principle of a dispensing portion and a discharge adjusting portion of a medicine dispensing device according to another embodiment of the present invention.

Referring to FIGS. 13 through 15, when the medicines M in the upright state are received by the dispensing portion 220 at the receiving position, an eighth spur gear G8 is rotated by the driving force provided by the first driving portion 270, and a ninth spur gear G9, a tenth spur gear G10, and an eleventh spur gear G11 are also rotated due to rotation of the eighth spur gear G8.

Here, when the ninth spur gear G9 is rotated, a dispensing protrusion P1 mounted on the ninth spur gear G9 is also rotated. The dispensing protrusion P1 is in contact with the support portion 222 of the dispensing portion 220 so that the support portion 222 can be rotated about the rotation shaft 272.

In detail, the support portion 222 may include a rounded surface 223 that comes in contact with the dispensing protrusion P1. The dispensing protrusion P1 is rotated by rotation of the ninth spur gear G9 and is moved along the rounded surface 223, as illustrated in FIGS. 14 and 15.

That is, the dispensing protrusion P1 is moved upward while being rotated. Thus, the rounded surface 223 is pushed upward so that the support portion 222 can be rotated about the rotation shaft 272.

When the eighth spur gear G8 is rotated by the driving force provided by the first driving portion 270 and the eleventh spur gear G11 is rotated due to rotation of the eighth spur gear G8, a discharge protrusion P2 mounted on the eleventh spur gear G11 is also rotated.

When the discharge protrusion P2 is rotated, the discharge protrusion P2 is moved along a through hole H1 of a connection portion 282 connected to the discharge adjusting portion 280. Due to the through hole H1 that is formed to be rounded, the connection portion 282 is moved in one direction and rotated.

Due to movement of the connection portion 282 in one direction and rotation of the connection portion 282, the discharge adjusting portion 280 may be moved upward and may cause the medicines M to be discharged to the outside.

However, position movement of the dispensing portion 220 and the discharge adjusting portion 280 is not necessarily implemented by the above-described gears but may be implemented by different types of gears or a timing belt.

Figure 16:
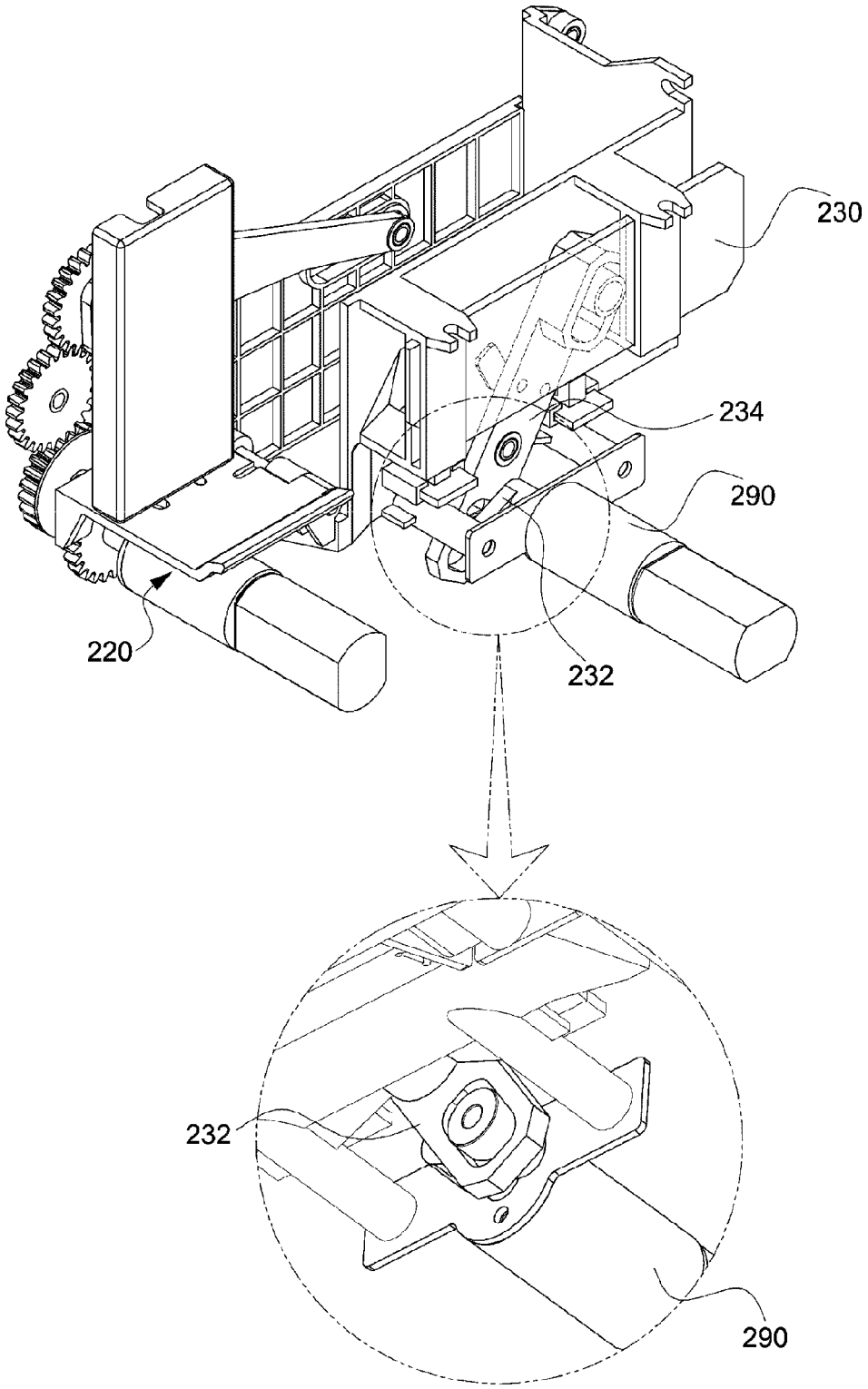
FIGS. 16 and 17 are views of an operating principle of a position movement preventing portion of a medicine dispensing device according to another embodiment of the present invention.
Figure 17:
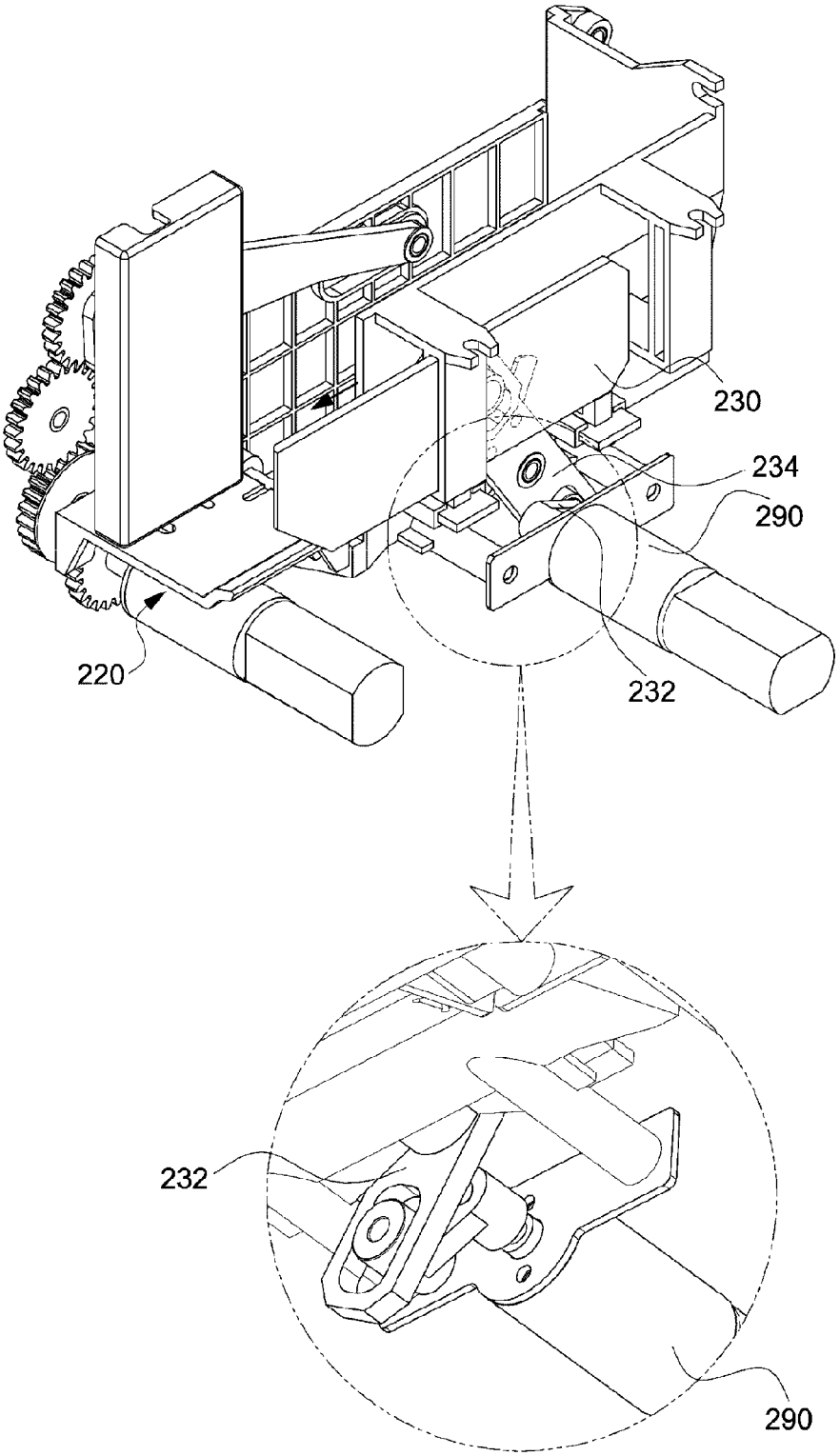

FIGS. 16 and 17 are views of an operating principle of a position movement preventing portion of a medicine dispensing device according to another embodiment of the present invention.

Referring to FIGS. 16 and 17, after the medicines M in the upright state are received by the dispensing portion 220 at the receiving position, the position movement preventing portion 230 may be transported by a driving force of the second driving portion 290 and may prevent position movement of the medicines M to be received later on.

In detail, a first link portion 232 connected to the second driving portion 290 is rotated by the driving force of the second driving portion 290. When the first link portion 232 is rotated, a second link portion 234 connected to the first link portion 232 is also rotated.

Here, when the second link portion 234 is rotated, the position movement preventing portion 230 connected to the second link portion 234 may be moved in a straight direction and may prevent communication between the entrance space S and the dispensing portion 220.

When the medicines M that pass through the entrance space S are dispensed by movement of the dispensing portion 220, the position movement preventing portion 230 may be returned to the state shown in FIG. 9 due to rotation of the first link portion 232. Thus, the position movement preventing portion 230 may allow communication between the entrance space S and the dispensing portion 220 so that the medicines M to be dispensed later on can be dispensed by the dispensing portion 220 at the receiving position.

Figure 18:
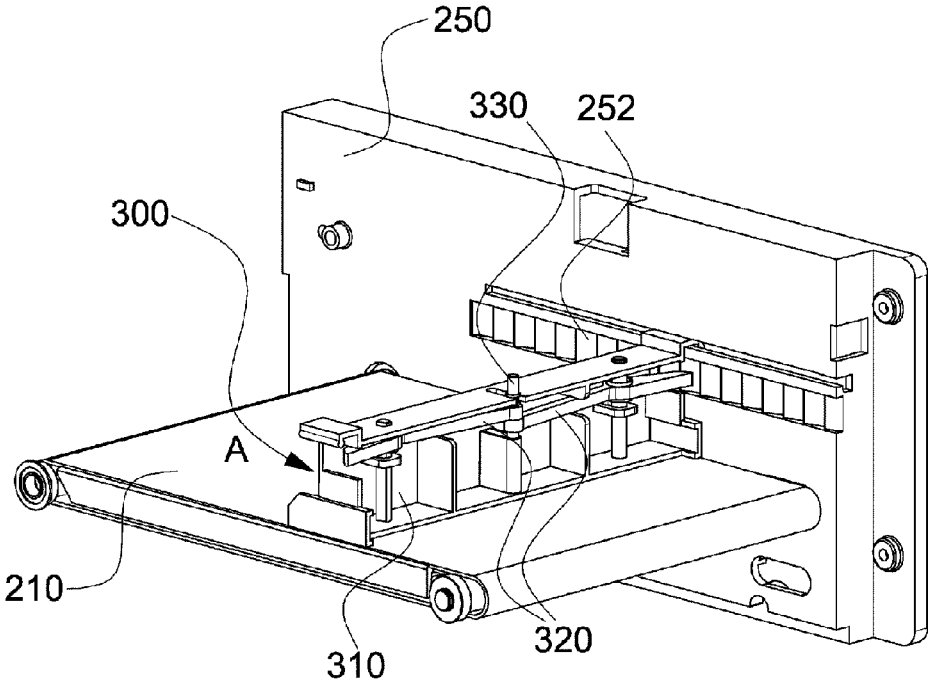
FIG. 18 is a view of an alignment portion of a medicine dispensing device according to another embodiment of the present invention.
Figure 19:
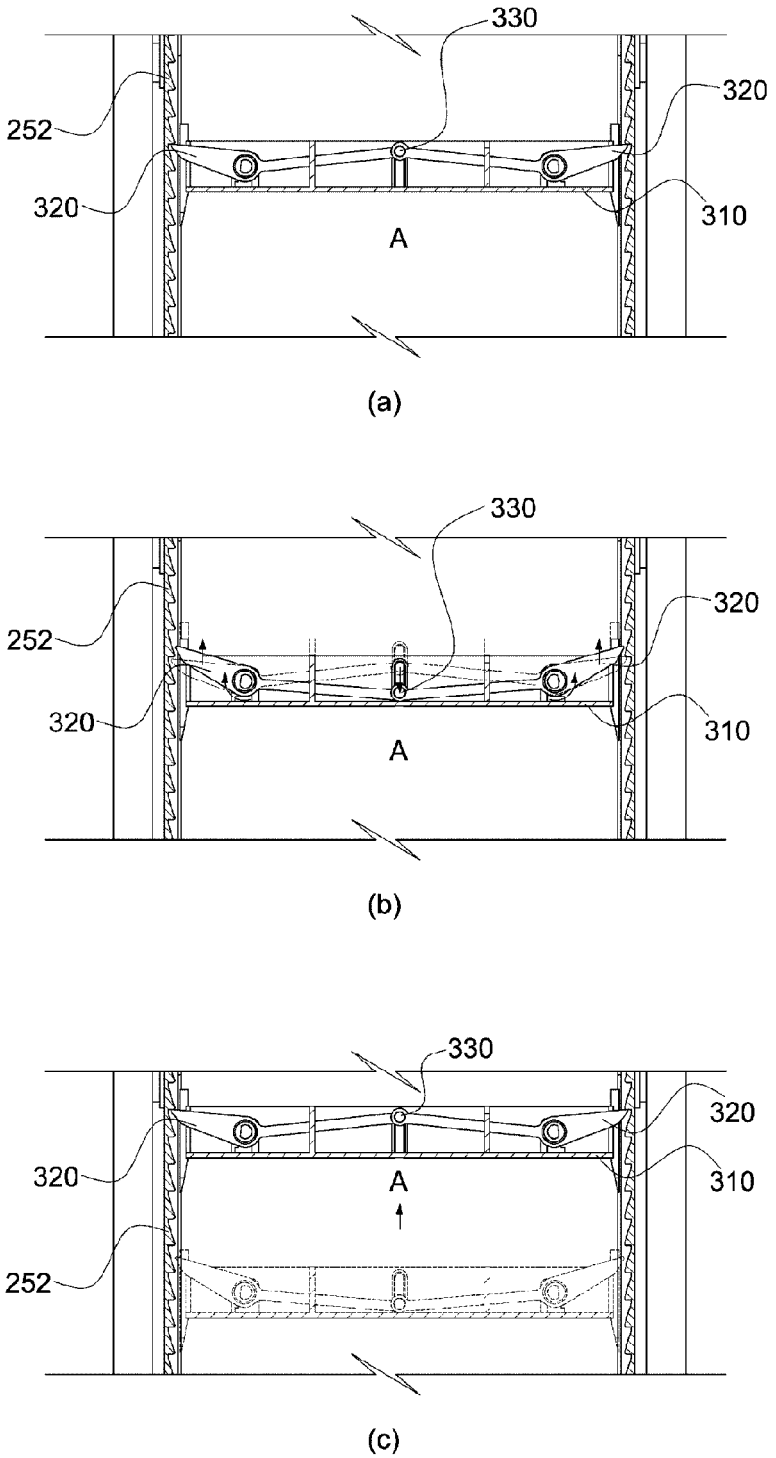
FIG. 19 is a view for explaining a position movement principle of an alignment portion of a medicine dispensing device according to another embodiment of the present invention.

FIG. 18 is a view of an alignment portion of a medicine dispensing device according to another embodiment of the present invention, and FIG. 19 is a view for explaining a position movement principle of an alignment portion of a medicine dispensing device according to another embodiment of the present invention.

Referring to FIGS. 18 and 19, an alignment portion 300 that is an element for defining the number of medicines M mounted on the medicine mounting portion 210 may define a space A of the medicine mounting portion 210 in which the medicines M are mounted.

The alignment portion 300 may include a support portion 310 that supports the medicines M and is in contact with the medicine mounting portion 210 so that the medicines M can be maintained in the upright state without being affected by inertia when the medicines M mounted on the medicine mounting portion 210 are transported, and a hangable portion 320 and a hangable-portion-moving portion 330 that are mounted on the support portion 310 so as to be transported such that the hangable portion 320 and the hangable-portion-moving portion 330 can be in contact with a hanging portion 252 formed on an inner surface of the body portion 25Q and can be moved together with the support portion 310.

The support portion 310 may be transported in the same direction in which the medicines M mounted on the medicine mounting portion 210 are transported due to contact with the medicine mounting portion 210. However, the support portion 310 cannot be moved in a direction opposite to the direction in which the medicines M are transported without an external force.

In detail, the hanging portion 252 may be repeatedly formed as an inclined surface. The hangable portion 320 may include an inclined end portion corresponding to the inclined surface.

Thus, the hangable portion 320 may be moved in the same direction in which the medicines M mounted on the medicine mounting portion 210 are transported. However, the hangable portion 320 is hung on a jaw of the hanging portion 252 and cannot be moved in an opposite direction.

Here, after the medicines M mounted on the medicine mounting portion 210 are dispensed by the dispensing portion 220, the alignment portion 300 is disposed at a position adjacent to the guide portion 240 and should be moved in the opposite direction for supply of new medicines M.

In this case, when an external force is applied to the hangable-portion-moving portion 330, as illustrated in FIG. 14, both ends of the hangable portion 320 may be rotated so that contact with the hanging portion 252 can be released.

A space in which new medicines M are to be mounted can be secured again by moving the hangable portion 320 in the opposite direction using the hangable-portion-moving portion 330 in a state in which the hangable portion 320 is spaced apart from the hanging portion 252. When the external force is removed, the hangable portion 320 comes in contact with the hanging portion 252 again due to elasticity.

Figure 20:
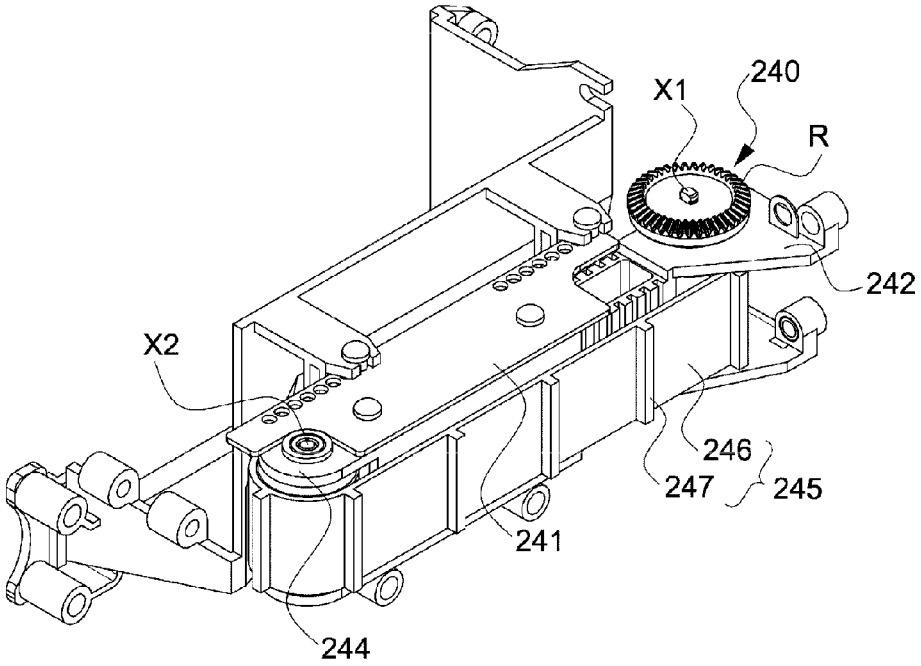
FIG. 20 is a schematic perspective view of a guide portion of a medicine dispensing device according to another embodiment of the present invention.
Figure 21:
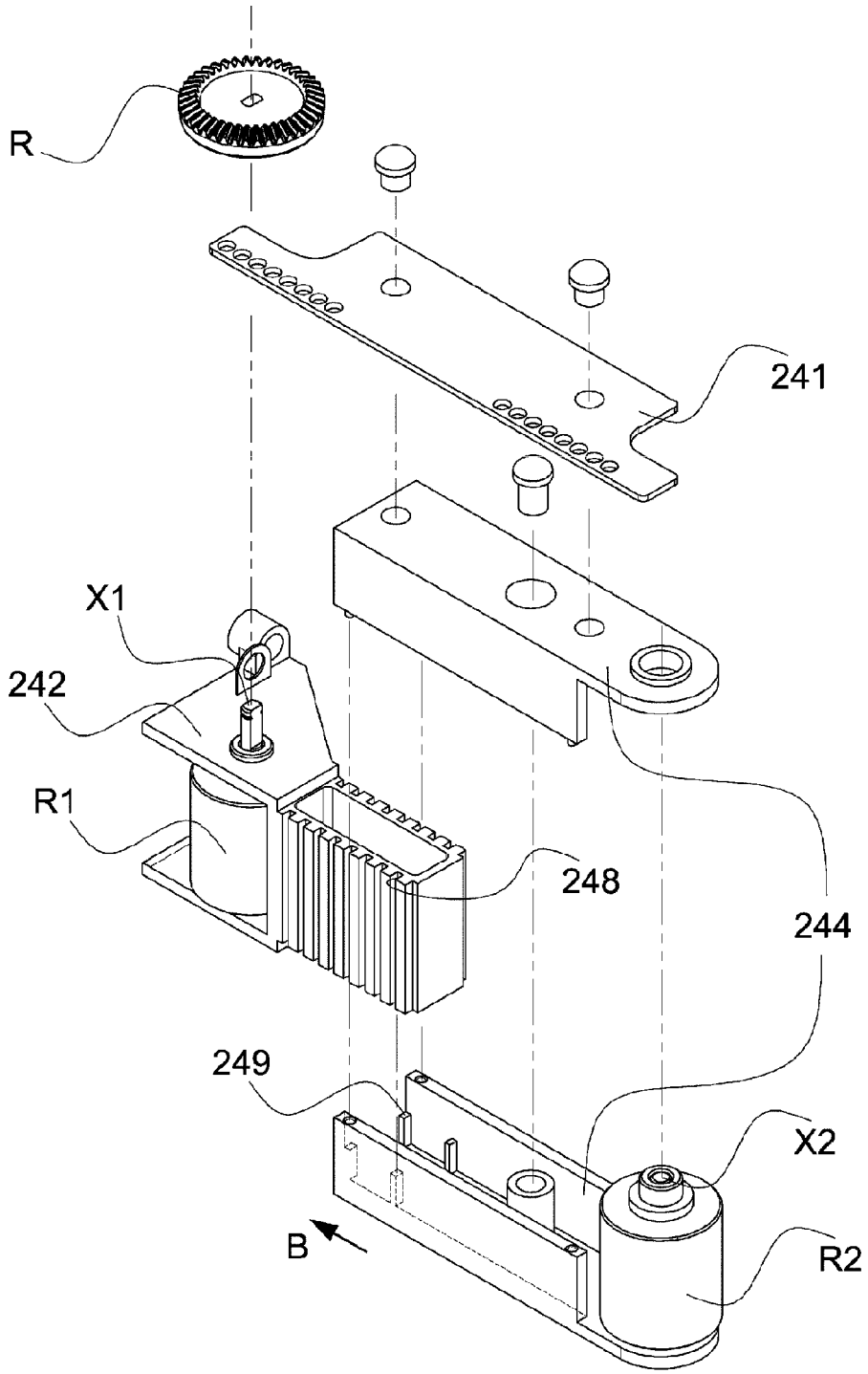
FIG. 21 is a schematic exploded perspective view of a guide portion of a medicine dispensing device according to another embodiment of the present invention.
Figure 22:
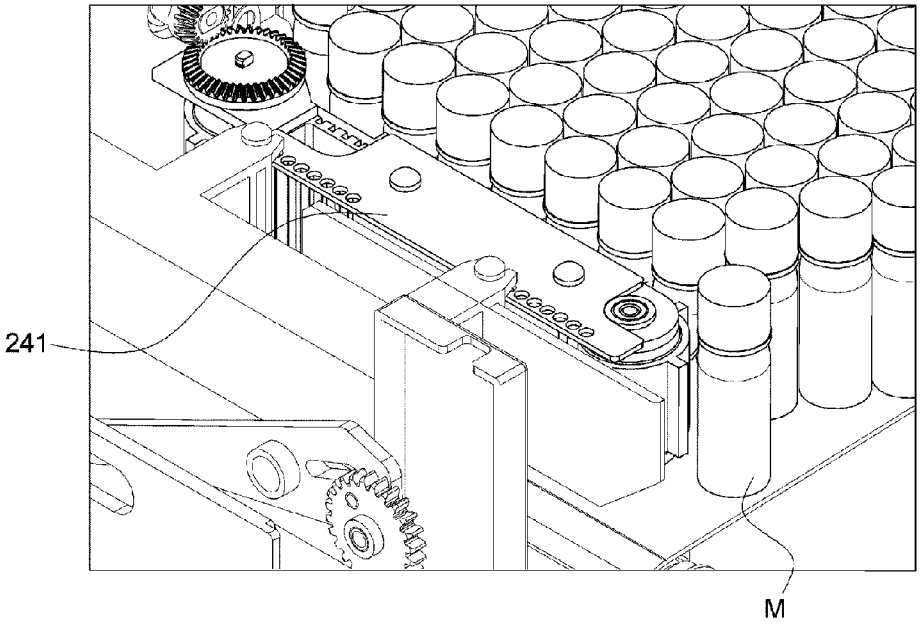
FIGS. 22 and 23 are views for explaining the size of an entrance space using the guide portion of a medicine dispensing device according to another embodiment of the present invention.
Figure 23:
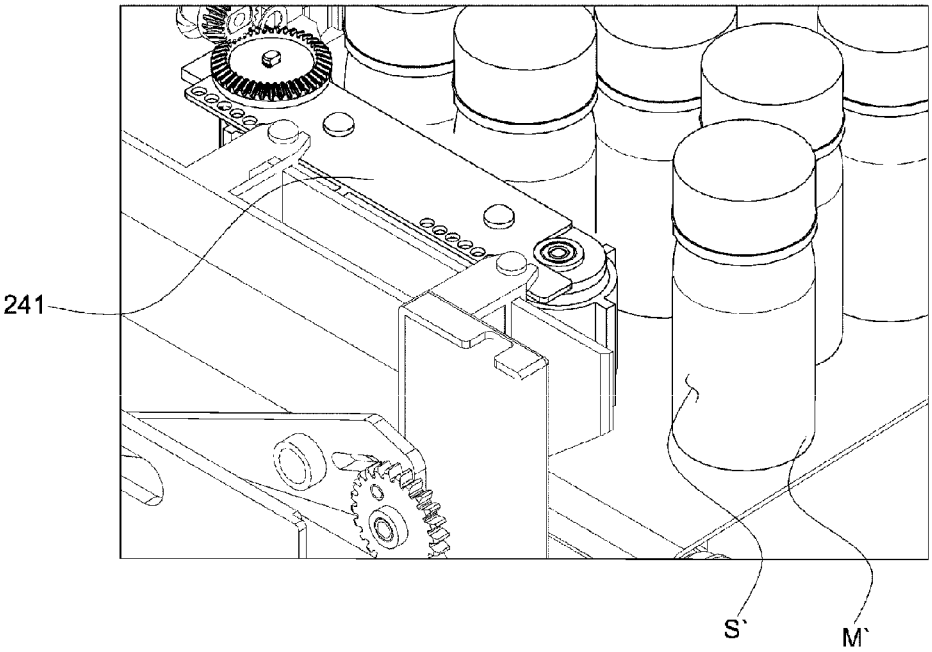

FIG. 20 is a schematic perspective view of a guide portion of a medicine dispensing device according to another embodiment of the present invention, FIG. 21 is a schematic exploded perspective view of a guide portion of a medicine dispensing device according to another embodiment of the present invention, and FIGS. 22 and 23 are views for explaining the size of an entrance space using the guide portion of a medicine dispensing device according to another embodiment of the present invention.

Referring to FIGS. 20 through 23, the guide portion 240 may include a reference guide portion 242 fixed to the body portion 250, a varying guide portion 244 mounted on the reference guide portion 242 so as to be transported, and a contact rotation portion 245 that rotates on the endless belt so as to guide the medicines M mounted on the medicine mounting portion 210 toward a position corresponding to the receiving position.

Here, the reference guide portion 242 and the varying guide portion 244 may include a reference axis X1 and a varying axis X2 for implementing rotation of the contact rotation portion 245. The reference axis X1 and the varying axis X2 may be linked to a reference roller R1 and a varying roller R2 and may be rotated.

The contact rotation portion 245 may contact the reference roller R1 and the varying roller R2. When the first reference axis X1 and the reference roller R1 are rotated by rotation of a ring gear R, the first reference axis X1 and the reference roller R1 may be linked to each other and may be moved to the endless belt.

The contact rotation portion 245 may include a movement portion 246 that is a kind of belt having elasticity and a plurality of pressurization portions 247 that are spaced apart from the movement portion 246 and protrude from the contact rotation portion 245 so as to pressurize the medicines M that come in contact with the movement portion 246 toward the entrance space S.

One of the reference guide portion 242 and the varying guide portion 244 may include an accommodation portion 248 that is depressed. The other may include an insertion portion 249 that is inserted into the accommodation portion 248 and causes a position of the varying guide portion 244 to be fixed to the reference guide portion 242.

For example, as illustrated in FIG. 21, the accommodation portion 248 and the insertion portion 249 may be formed at the reference guide portion 242 and the varying guide portion 244, respectively.

A plurality of accommodation portions 248 may be spaced apart from each other, and a unit for adjusting the size of the entrance space S may be determined based on a separation distance.

That is, when the reference guide portion 242 and the varying guide portion 244 are separated from the guide portion 240 in the state shown in FIG. 20, are maintained in the state shown in FIG. 21 and then are moved in a direction of arrow B and combined with each other, the guide portion 240 in the state shown in FIG. 23 may be implemented.

The reference guide portion 242 and the varying guide portion 244 may be fixed to the body portion 250 using a fixing portion 241.

In this case, the size of an entrance space S' may be greater than that of FIG. 22. Medicines M' having relatively larger sizes than those of FIG. 22 may also be dispensed.

A distance between the reference axis X1 and the varying axis X2 decreases the size of the entrance space S increases as the varying guide portion 244 moves in the direction of arrow B, and thus the distance and the size of the entrance space S may be in inverse proportion to each other.

In addition, the size of the entrance space S may be determined based on a region in which the reference guide portion 242 and the varying guide portion 244 overlap, and the size of the entrance space S and the region may be in inverse proportion to each other.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A medicine dispensing device which dispenses a plurality of medicines in vials one by one, wherein the plurality of medicines are placed in an internal space of the medicine dispensing device in an upright state, the medicine dispensing device comprising:

a medicine mounting portion for placing the plurality of medicines in the upright state in the internal space, wherein the plurality of medicines is transported in the upright state by a movement of the medicine mounting portion;

a dispensing portion for dispensing one of the plurality of medicines transported by the medicine mounting portion in the upright state outside to be in a laid state;

a guide portion defining an entrance space in which the one of the plurality of medicines enters the dispensing portion; and a position movement preventing portion for blocking at least another of the plurality of medicines which would be dispensed next time from entering the entrance space, when the one of the plurality of medicines passes through the entrance space, wherein the medicine mounting portion moves in a first direction for the one of the plurality of medicines to pass through the entrance space, wherein the guide portion moves in a second direction, in which the plurality of medicines contacted with the guide portion are guided to the entrance space in the upright state on the medicine mounting portion, whereby the one of the plurality of medicines passes through the entrance space in the upright state on the medicine mounting portion, and wherein the first direction is different from the second direction.

2. The medicine dispensing device of claim 1, wherein the dispensing portion moves between a receiving position at which the one of the plurality of medicines transported by the medicine mounting portion is received in the upright state and a dispensing position at which the received one of the plurality of medicines is dispensed, and receives the one of the plurality of medicines that enters the entrance space in the upright state at the receiving position and then dispenses the one of the plurality of medicines in a different direction from a direction in which the one of the plurality of medicines is received when the dispensing portion reaches the dispensing position, or before.

3. The medicine dispensing device of claim 2, wherein the dispensing portion receives the one of the plurality of medicines that enters the entrance space in the upright state at the receiving position and then is moved to the dispensing position by rotation and then dispenses the one of the plurality of medicines in the upright state to be in a laid state.

4. The medicine dispensing device of claim 1, wherein the guide portion causes a size of the entrance space to be adjusted based on sizes of the medicines.

5. The medicine dispensing device of claim 2, wherein the guide portion comprises:

a reference guide portion fixed to a predetermined position;

a varying guide portion mounted on the reference guide portion so as to be transported; and a contact rotation portion that rotates on an endless belt so as to guide the plurality of medicines placed on the medicine mounting portion to the position corresponding to the receiving position.

6. The medicine dispensing device of claim 5, wherein the reference guide portion and the varying guide portion comprise a reference axis and a varying axis for rotation of the contact rotation portion, respectively.

7. The medicine dispensing device of claim 5, wherein the size of the entrance space is determined based on a region in which the reference guide portion and the varying guide portion overlap.

8. The medicine dispensing device of claim 5, wherein one of the reference guide portion and the varying guide portion comprises an accommodation portion that is depressed, and the other one of the reference guide portion and the varying guide portion comprises an insertion portion that is inserted into the accommodation portion and causes a position of the varying guide portion to be fixed to the reference guide portion.

9. The medicine dispensing device of claim 8, wherein a plurality of accommodation portions are spaced apart from each other, and a unit for adjusting the size of the entrance space is determined based on a separation distance.

10. The medicine dispensing device of claim 5, wherein the contact rotation portion comprises a movement portion and a plurality of pressurization portions that are spaced apart from the movement portion and protrude from the contact rotation portion so as to pressurize at least one of the plurality of medicines that comes in contact with the movement portion toward the entrance space.

11. The medicine dispensing device of claim 5, wherein the contact rotation portion is linked to the medicine mounting portion and rotates on the endless belt.

12. The medicine dispensing device of claim 2, wherein the medicine mounting portion causes the one of the plurality of the medicines that enters the entrance space to be received by the dispensing portion at the receiving position.

13. The medicine dispensing device of claim 1, wherein, when the one of the plurality of the medicines placed on the medicine mounting portion passes through the entrance space, the position movement preventing portion is transported and prevents communication between the entrance space and the dispensing portion, and when the one of the plurality of the medicines that passes through the entrance space is dispensed by movement of the dispensing portion, the position movement preventing portion is returned to its original position and allows communication between the entrance space and the dispensing portion.

14. The medicine dispensing device of claim 1, further comprising a discharge adjusting portion that adjusts whether the one of the plurality of the medicines dispensed by the dispensing portion is discharged to an outside, wherein the discharge adjusting portion is linked to the dispensing portion.

15. The medicine dispensing device of claim 1, further comprising an alignment portion that defines the number of the plurality of medicines placed on the medicine mounting portion and is transported in the same direction in which the plurality of the medicines placed on the medicine mounting portion are transported, so that the plurality of medicines placed on the medicine mounting portion can be maintained in the upright state when the medicines placed on the medicine mounting portion are transported.

* * * * *